US009695024B2

(12) United States Patent
Herauf

(10) Patent No.: US 9,695,024 B2
(45) Date of Patent: Jul. 4, 2017

(54) UNIQUE ROADWORTHY SIDEWALK BOOM TRAILER, HAVING ON-SITE INTERCHANGEABLE BOOM, ON-SITE INTERCHANGEABLE LADDER, AND ON-SITE INTERCHANGEABLE CATWALK SIZED TO ACCESS NARROW OPENINGS AND NOOKS OVER AND UNDER BRIDGES

(71) Applicant: Jeremy Herauf, Fairview, OR (US)

(72) Inventor: Jeremy Herauf, Fairview, OR (US)

( * ) Notice: Subject to any disclaimer, the term of this patent is extended or adjusted under 35 U.S.C. 154(b) by 191 days.

(21) Appl. No.: 14/604,001

(22) Filed: Jan. 23, 2015

(65) Prior Publication Data

US 2016/0214842 A1 Jul. 28, 2016

(51) Int. Cl.
*B66F 11/04* (2006.01)
*E01D 19/10* (2006.01)

(52) U.S. Cl.
CPC ..... *B66F 11/044* (2013.01); *E01D 19/106* (2013.01)

(58) Field of Classification Search
CPC ..... B66F 11/044; B66F 11/046; B66F 11/042; B66F 11/04; B66F 11/00; E01D 19/106
See application file for complete search history.

(56) References Cited

U.S. PATENT DOCUMENTS 2,669,490 A * 2/1954 Kaufman ..... E01D 19/106 182/145
3,076,522 A * 2/1963 Goodell ..... E01D 19/106 182/13
3,262,517 A * 7/1966 Malec ..... B66F 11/046 182/127
3,357,517 A * 12/1967 Wagner ..... B66F 11/044 182/2.6
3,456,756 A 7/1969 Price
3,498,474 A * 3/1970 Pierce, Jr. ..... B66F 11/044 182/141
3,608,669 A * 9/1971 Lindsay, Jr. ..... E01D 19/106 182/14
3,774,719 A 11/1973 Lindsay, Jr.
(Continued)

*Primary Examiner* — Katherine Mitchell
*Assistant Examiner* — Shiref Mekhaeil

(57) ABSTRACT

A unique roadworthy boom trailer comprises a roadworthy wheeled chassis, four independently-adjustable trailer-leveling motorized legs attached to the bottom of the chassis, pneumatic-tool compressor built in the chassis, turret assembly attached to the top of the chassis, and on-site-extendable-interchangeable quick-release assemblies of boom, ladder, and catwalk rotatably attached to the turret assembly. The ladder assembly has safety rungs for safety cables to be hooked thereon. The catwalk assembly has adjustable telescopic safety handrails. The unique roadworthy boom trailer can work with suspension-cable-or-truss-type bridges, low-or-high-power-line bridges, short-or-tall-supporting-column bridges, single-or-multiple-lane bridges, and regular-or-railroad bridges. The catwalk assembly can have multiple additional catwalk assemblies attached thereto to extend its width or length to generally equal the width or length of a bridge, respectively. The catwalk assembly is sized to operate entirely within the width of a sidewalk, and to lift and shift equipment and personnel through narrow openings or into nooks both over and under bridges.

19 Claims, 19 Drawing Sheets

(56) References Cited

U.S. PATENT DOCUMENTS 4,044,858 A 8/1977 Vikre
4,074,790 A * 2/1978 Colbachini ..... E01D 19/106 182/150
4,154,318 A * 5/1979 Malleone ..... E04G 3/28 182/12
4,179,010 A 12/1979 Ashworth
4,360,077 A 11/1982 Abbott
4,418,791 A * 12/1983 Frey-Wigger ..... B66F 11/046 182/150
4,449,611 A * 5/1984 Frey-Wigger ..... E01D 19/106 182/142
4,461,369 A * 7/1984 Amador ..... E01D 19/106 182/2.6
4,556,124 A * 12/1985 Lotto ..... E01D 19/106 182/2.6
4,569,416 A 2/1986 Stokoe
4,624,340 A 11/1986 Astrom et al.
4,633,975 A * 1/1987 Connor ..... E01D 19/106 182/143
4,646,875 A * 3/1987 Sholl ..... E01D 19/106 182/2.6
4,684,314 A 8/1987 Luth
4,690,247 A * 9/1987 Yoshida ..... B66F 11/046 182/148
4,696,371 A * 9/1987 Moog ..... E01D 19/106 182/2.6
4,877,422 A * 10/1989 Walbridge ..... B66F 11/044 182/2.4
4,890,692 A 1/1990 Oakman
5,011,710 A 4/1991 Harrison
5,253,731 A * 10/1993 Moog ..... E01D 19/106 182/2.6
5,297,653 A 3/1994 Wurtz et al.
5,299,653 A * 4/1994 Nebel ..... B66F 11/044 182/113
5,318,149 A * 6/1994 Moog ..... E01D 19/106 182/2.6
5,435,410 A * 7/1995 Langston ..... B66C 23/78 182/2.6
5,695,388 A 12/1997 Lyras et al.
5,746,286 A * 5/1998 Mlaker ..... B66F 11/044 182/2.1
5,755,306 A 5/1998 Kraemer et al.
6,250,485 B1 * 6/2001 Olson ..... B66F 11/044 182/2.8
6,507,163 B1 * 1/2003 Allen ..... B25J 9/162 14/78
6,585,079 B1 7/2003 Weyer
6,598,702 B1 * 7/2003 McGillewie, Jr. .... E01D 19/106 182/2.6
6,823,888 B1 * 11/2004 Raymond ..... E04G 21/04 137/351
7,035,758 B1 4/2006 Jerome
7,850,024 B2 12/2010 Schneider et al.
7,926,670 B2 4/2011 Schneider
8,016,074 B2 * 9/2011 Black ..... B66F 11/044 182/113
8,083,461 B2 12/2011 Smith et al.
8,467,741 B2 * 6/2013 Newman ..... H01Q 1/1235 455/561
8,857,567 B1 * 10/2014 Raymond ..... B66C 23/702 182/2.1
2002/0144862 A1 * 10/2002 Engvall ..... B66F 17/006 182/18
2004/0262078 A1 * 12/2004 Bailey ..... B66F 17/006 182/2.1

* cited by examiner

UNIQUE ROADWORTHY SIDEWALK BOOM TRAILER, HAVING ON-SITE INTERCHANGEABLE BOOM, ON-SITE INTERCHANGEABLE LADDER, AND ON-SITE INTERCHANGEABLE CATWALK SIZED TO ACCESS NARROW OPENINGS AND NOOKS OVER AND UNDER BRIDGES

FIELD OF THE INVENTION

The present invention relates to a unique built-in-pneumatic-tool-compressor interchangeable-extendable-boom-assembly roadworthy trailer. Particularly, the present invention relates to a unique built-in-pneumatic-tool-compressor on-site-extendable-interchangeable-boom on-site-extendable-interchangeable-ladder on-site-extendable-interchangeable-catwalk roadworthy-wheel-and-tire trailer, having:

1) Capabilities and dimensions to operate entirely within the width of a sidewalk;
2) Capabilities and dimensions to operate through small openings (each less than 30 inches wide);
3) Capabilities and dimensions to maneuver in small nooks and crannies under bridges;
4) Capabilities and dimensions to operate safely under low power lines;
5) Capabilities and dimensions to operate on:
   small and large suspension-cable-type bridges (suspension bridges),
   small and large truss-type bridges,
   small and large low-power-line bridges,
   small and large high-power-line bridges,
   small and large short-supporting-column bridges,
   small and large tall-supporting-column bridges,
   small and large single-lane bridges,
   small and large multiple-lane bridges,
   small and large regular bridges, and
   small and large rail-road bridges;
6) Capabilities and dimensions to be towed by a regular truck;
7) Roadworthy chassis, wheels, and tires;
8) Built-in pneumatic tool compressor;
9) Built-in independently-adjustable trailer-leveling motorized legs;
10) On-site-extendable-interchangeable boom;
11) On-site-extendable-interchangeable safety-cable-attaching-rung ladder; and
12) On-site-extendable-interchangeable adjustable-telescopic-safety-handrail catwalk.

DESCRIPTION OF THE PRIOR ART

A number of boom vehicles have been introduced.

U.S. Pat. No. 3,262,517, patented 1966 Jul. 26, to J. P. Malec;
U.S. Pat. No. 3,357,517, patented 1967 Dec. 12, to E. A. Wagner;
U.S. Pat. No. 3,456,756, patented 1969 Jul. 22, to B. J. Price;
U.S. Pat. No. 3,608,669, patented 1971 Sep. 28, to Lindsay, Jr.;
U.S. Pat. No. 3,774,719, patented 1973 Nov. 27, to Lindsay, Jr.;
U.S. Pat. No. 4,044,858, patented 1977 Aug. 30, to Vikre;
U.S. Pat. No. 4,074,790, patented 1978 Feb. 21, to Colbachini, et al.;
U.S. Pat. No. 4,154,318, patented 1979 May 15, to Malleone;

U.S. Pat. No. 4,179,010, patented 1979 Dec. 18, to Ashworth;
U.S. Pat. No. 4,360,077, patented 1982 Nov. 23, to Abbott;
U.S. Pat. No. 4,449,611, patented 1984 May 22, to Frey-Wigger;
U.S. Pat. No. 4,461,369, patented 1984 Jul. 24, to Amador;
U.S. Pat. No. 4,556,124, patented 1985 Dec. 3, to Lotto;
U.S. Pat. No. 4,569,416, patented 1986 Feb. 11, to Stokoe;
U.S. Pat. No. 4,624,340, patented 1986 Nov. 25, to Astrom, et al.;
U.S. Pat. No. 4,633,975, patented 1987 Jan. 6, to Connor, et al.;
U.S. Pat. No. 4,646,875, patented 1987 Mar. 3, to Sholl;
U.S. Pat. No. 4,684,314, patented 1987 Aug. 4, to Luth;
U.S. Pat. No. 4,690,247, patented 1987 Sep. 1, to Yoshida;
U.S. Pat. No. 4,696,371, patented 1987 Sep. 29, to Moog;
U.S. Pat. No. 4,890,692, patented 1990 Jan. 2, to Oakman;
U.S. Pat. No. 5,011,710, patented 1991 Apr. 30, to Harrison;
U.S. Pat. No. 5,253,731, patented 1993 Oct. 19, to Moog;
U.S. Pat. No. 5,297,653, patented 1994 Mar. 29, to Wurtz, et al.;
U.S. Pat. No. 5,318,149, patented 1994 Jun. 7, to Moog;
U.S. Pat. No. 5,435,410, patented 1995 Jul. 25, to Langston;
U.S. Pat. No. 5,695,388, patented 1997 Dec. 9, to Lyras, et al.;
U.S. Pat. No. 5,746,286, patented 1998 May 5, to Mlaker;
U.S. Pat. No. 5,755,306, patented 1998 May 26, to Kraemer, et al.;
U.S. Pat. No. 6,250,485, patented 2001 Jun. 26, to Olson;
U.S. Pat. No. 6,507,163, patented 2003 Jan. 14, to Allen;
U.S. Pat. No. 6,585,079, patented 2003 Jul. 1, to Weyer;
U.S. Pat. No. 6,598,702, patented 2003 Jul. 29, to McGillewie, Jr., et al.;
U.S. Pat. No. 6,823,888, patented 2004 Nov. 30, to Raymond;
U.S. Pat. No. 7,035,758, patented 2006 Apr. 25, to Jerome;
U.S. Pat. No. 7,850,024, patented 2010 Dec. 14, to Schneider, et al.;
U.S. Pat. No. 7,926,670, patented 2011 Apr. 19, to Schneider;
U.S. Pat. No. 8,016,074, patented 2011 Sep. 13, to Black, et al.;
U.S. Pat. No. 8,083,461, patented 2011 Dec. 27, to Smith, et al.;
U.S. Pat. No. 8,467,741, patented 2013 Jun. 18, to Newman;
U.S. Pat. No. 8,857,567, patented 2014 Oct. 14, to Raymond;
U.S. Publication. No. 20020144862, published 2002 Oct. 10, to Engvall, David P.; and
U.S. Publication. No. 20040262078, published 2004 Dec. 30, to Bailey, Jeffrey H.

disclose a variety of inventions related to boom vehicles.

The prior art have failed to solve many problems associated with such boom vehicles, as follows:

1) No prior art (FIGS. 1 (PRIOR ART) and 2 (PRIOR ART) mention or disclose any boom trailer (having unique on-site-extendable-interchangeable quick-release boom assembly and on-site-extendable-interchangeable catwalk assembly), which.
   can lift and shift equipment and personnel through narrow openings over and under bridges (for example, through a less-than-30-inch-wide opening between two cables of a small suspension-cable-type bridge or between two posts of a small truss-type bridge),
   can lift and shift bridge-maintenance goods through narrow openings over and under bridges (for example, through a less-than-30-inch-wide opening between two cables of a small suspension-cable-type bridge or between two posts of a small truss-type bridge);

Therefore, the prior-art boom trailers are limited and expensive, and require additional boom trailers to maintain and service bridges.

2) No prior art (FIGS. 1 (PRIOR ART) and 2 (PRIOR ART) mention or disclose any boom trailer (having unique dimensions), which can maneuver and work in small areas, nooks, and crannies (for example, in a less-than-30-inch-wide nook or cranny) over and under all:

small and large suspension-cable-type bridges (suspension bridges),
small and large truss-type bridges,
small and large low-power-line bridges,
small and large high-power-line bridges,
small and large short-supporting-column bridges,
small and large tall-supporting-column bridges,
small and large single-lane bridges,
small and large multiple-lane bridges,
small and large regular bridges, and
small and large rail-road bridges.

Therefore, the prior-art boom trailers are limited in maneuvering through many narrow openings, and require a lot of labor, time, and money to maintain and service bridges.

3) No prior art (FIGS. 1 (PRIOR ART) and 2 (PRIOR ART) mention or disclose any boom trailer (having unique capabilities), which can work with all:

small and large suspension-cable-type bridges (suspension bridges),
small and large truss-type bridges,
small and large low-power-line bridges,
small and large high-power-line bridges,
small and large short-supporting-column bridges,
small and large tall-supporting-column bridges,
small and large single-lane bridges,
small and large multiple-lane bridges,
small and large regular bridges, and
small and large rail-road bridges.

Therefore, the prior-art boom trailers are limited and expensive, and require additional boom trailers to maintain and service bridges.

4) No prior art (FIGS. 1 (PRIOR ART) and 2 (PRIOR ART) mention or disclose any boom trailer (having unique dimensions, roadworthy chassis, roadworthy wheels, roadworthy tires, and four independently-adjustable trailer-leveling motorized legs), which can operate entirely within the width of a sidewalk, can be towed on the road at highway speed, and can be leveled when situated on uneven terrain.

Therefore, the prior-art boom trailers have to be disassembled, loaded on a roadworthy trailer, unloaded from a roadworthy trailer, and re-assembled when towed from one worksite to another. And therefore, the prior-art boom trailers are inconvenient, cumbersome, labor-intensive, time-consuming, and expensive to operate.

5) No prior art (FIG. 2 (PRIOR ART) mention or disclose any boom trailer (having unique dimensions, roadworthy chassis, roadworthy wheels, and roadworthy tires), which is compact, pre-installed, ready for operation, cheap to operate and maintain, and can be towed by a small, affordable, regular truck, which does not require any special driving license to be operated.

Therefore, the prior-art-boom trailers require big, expensive, and specialized trucks, and special driving license to operate it.

6) No prior art (FIGS. 1 (PRIOR ART) and 2 (PRIOR ART) mention or disclose any boom trailer (having unique built-in-pneumatic-tool compressor, pre-installed and ready-for-operation boom assembly, pre-installed and ready-for-operation ladder assembly, and pre-installed and ready-for-operation catwalk assembly), which reduces setup time, allows easy access to tight and usual spaces, is convenient, and saves time and money.

Therefore, the prior-art boom trailers require a lot of setup time, are inefficient in accessing and maneuvering in tight spaces over and under bridges, are inconvenient, and waste time and money.

7) No prior art (FIG. 1 (PRIOR ART) mention or disclose any boom trailer (having unique low compact profile sticking up in the air), which:

Can work, safely, in the proximity of low power lines on bridges,
Can deploy within a bridge sidewalk, and
Can deploy within a bridge sidewalk and/or one traffic lane, with its compact boom & basket assembly never encroaching into the second traffic lane.

Therefore, the prior-art boom trailers cause a lot of injuries, property damage, medical expenses, and waste a lot of time and money.

8) No prior art (FIGS. 1 (PRIOR ART) and 2 (PRIOR ART) mention or disclose any boom trailer (having unique extendable and interchangeable quick-release boom assembly, extendable and interchangeable quick-release ladder assembly, extendable and interchangeable anti-slip-grid catwalk assembly, and vertically telescopic adjustable safety handrail on its catwalk), which can be reconfigured on site for a large variety of maintenance and service projects.

Therefore, the prior-art boom trailers require a lot of storage space, are cumbersome to transport, are cumbersome to maneuver together on a bridge, block traffic in multiple lanes, are expensive to operate, and are impossible to combine into one boom trailer.

OBJECTS AND ADVANTAGES OF THE INVENTION

The present invention substantially departs from the conventional concepts and designs of the prior art. In doing so, the present invention provides a unique built-in-pneumatic-tool-compressor on-site-extendable-interchangeable-boom on-site-extendable-interchangeable-ladder on-site-extendable-interchangeable-catwalk roadworthy-wheel-and-tire trailer, having many unique and significant features, functions, and advantages, which overcome all the disadvantages of the prior art, as follows:

1) It is an object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:

a) Can work on:

small and large suspension-cable-type bridges (suspension bridges),
small and large truss-type bridges,
small and large low-power-line bridges,
small and large high-power-line bridges,
small and large short-supporting-column bridges,
small and large tall-supporting-column bridges,
small and large single-lane bridges, small and large multiple-lane bridges,
small and large regular bridges, and
small and large rail-road bridges;

b) Has an extendable interchangeable quick-release boom assembly and an extendable interchangeable anti-slip-grid catwalk assembly, which can maneuver and work in small areas, nooks, and crannies under:
small and large suspension-cable-type bridges (suspension bridges),
small and large truss-type bridges,
small and large low-power-line bridges,
small and large high-power-line bridges,
small and large short-supporting-column bridges,
small and large tall-supporting-column bridges,
small and large single-lane bridges,
small and large multiple-lane bridges,
small and large regular bridges, and
small and large rail-road bridges;

c) Has an extendable interchangeable quick-release boom assembly and an extendable interchangeable anti-slip-grid catwalk assembly, which:
can lift and shift equipment and personnel through narrow openings over and under bridges (for example, through a less-than-30-inch-wide opening between two cables of a small suspension-cable-type bridge or between two posts of a small truss-type bridge),
can lift and shift bridge-maintenance goods through narrow openings over and under bridges (for example, through a less-than-30-inch-wide opening between two cables of a small suspension-cable-type bridge or between two posts of a small truss-type bridge);

d) Has four independently-adjustable trailer-leveling motorized legs for adjusting the height at the trailer's four corners, to level the trailer when situated on uneven terrain;

e) Has roadworthy chassis, wheels, and tires such that the unique trailer can be towed at highway speed; and f) Can be sized to operate entirely within the width of a sidewalk.

2) It is another object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
a) Is able to be towed from one bridge to another, with its boom assembly, ladder assembly, and catwalk assembly pre-installed thereon,
b) Eliminates the need for an extra roadworthy trailer to carry it from one bridge to another,
c) Saves materials, production costs, labor, time, and money,
d) Eliminates the need for loading it on a roadworthy trailer to carry it to a worksite,
e) Eliminates the need for unloading it from a roadworthy trailer,
f) Eliminates the need for assembling it,
g) Eliminates the need for disassembling it, and
h) Eliminates the need for loading it back on a roadworthy trailer to carry it to another worksite.

3) It is a further object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
a) Is compact, versatile, pre-installed, and ready for operation,
b) Is cheap to operate and maintain,
c) Can be towed by a small, affordable, regular truck, which does not require any special driving license to be operated,
d) Eliminates the need for big, expensive, and specialized truck, and special driving license, and
e) Reduces setup time, and saves time and money.

4) It is an even further object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which, having its turret assembly permanently welded to its deck, and its boom assembly and catwalk assembly pre-installed:
a) Provides stability,
b) Eliminates the need for setting it up, and
c) Saves setup labor and time.

5) It is another object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
a) Has a low compact profile sticking up in the air,
b) Can provide a safe working trailer, in the proximity of low power lines on bridges,
c) Can deploy within a bridge sidewalk, and
d) Can deploy within a bridge sidewalk and/or one traffic lane, with its compact boom and catwalk assembly never encroaching into the second traffic lane.

6) It is yet another object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
a) Has vertically telescopic adjustable safety handrail on its catwalk or basket for workers to lean on and hold on while working, for added safety,
b) Has safety rungs for safety cables, yoyos, fall arrest systems, and/or lanyards to be attached thereto for added safety and maneuverability of workers, and
c) Prevents accidents and personal injuries, and saves time and money.

7) It is still yet another object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
a) Has extendable and interchangeable quick-release boom assembly (with quick-release pins for quick and easy reconfiguration while situated on a bridge) for specific bridge maintenances and services, to provide efficiency, to provide extended horizontal and vertical reaches, to save time, and to save bridge-maintenance-and-service costs,
b) Has extendable and interchangeable quick-release ladder assembly (with quick-release pins for quick and easy reconfiguration while situated on a bridge) for specific bridge maintenances and services, to provide efficiency, to provide extended horizontal and vertical reaches, to save time, and to save bridge-maintenance-and-service costs, and
c) Has extendable and interchangeable anti-slip-grid catwalk or basket assembly (with quick-release pins for quick and easy reconfiguration while situated on a bridge) for specific bridge maintenances and services, to provide efficiency, to provide extended horizontal and vertical reaches, to save time, and to save bridge-maintenance-and-service costs.

8) It is still yet an even further object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
   a) Has convenient built-in-pneumatic-tool compressor to run power tools,
   b) Has easily and safely accessible, walk-in utility vaults & utility storage, and
   c) Has hydraulic motor, pump, and tank located next to the turret assembly to allow for quick activation of the hydraulic system, and save materials, production costs, and money, 9) It is still yet an even further object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
   a) Has the turret control located to its catwalk or basket to be operated therefrom to prevent accidents and personal injuries, and to increase efficiency, and
   b) Has fuel filler located next to its sidewalk side to be easily accessible, to provide safety, convenience, and efficiency when refilling the unique trailer's fuel tank.

10) It is still yet an even further object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
   a) Has its deck fully coated with anti-slip coating to prevent personal injuries, and
   b) Has angled stop-and-go lights relocated to its two front corners to allow both driver and worker see them to better communicate with each other to increase efficiency and to prevent personal injuries.

Other objects and advantages of the present invention will become apparent from a consideration of the accompanying drawings and ensuing description.

SUMMARY OF THE INVENTION

Figure 1:
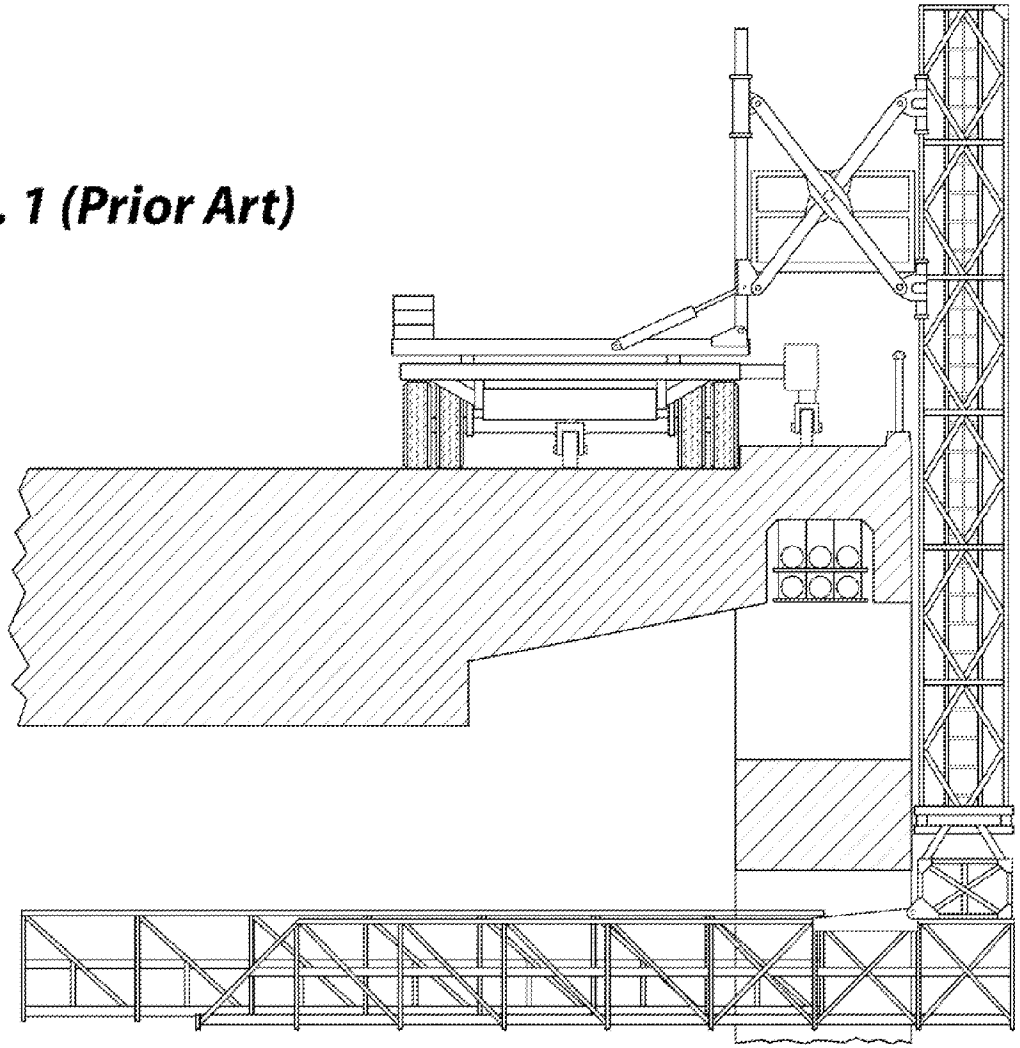
Fig. 1 (Prior Art)
FIG. 1 (Prior Art) illustrates the disadvantages of the prior art.
Figure 2:
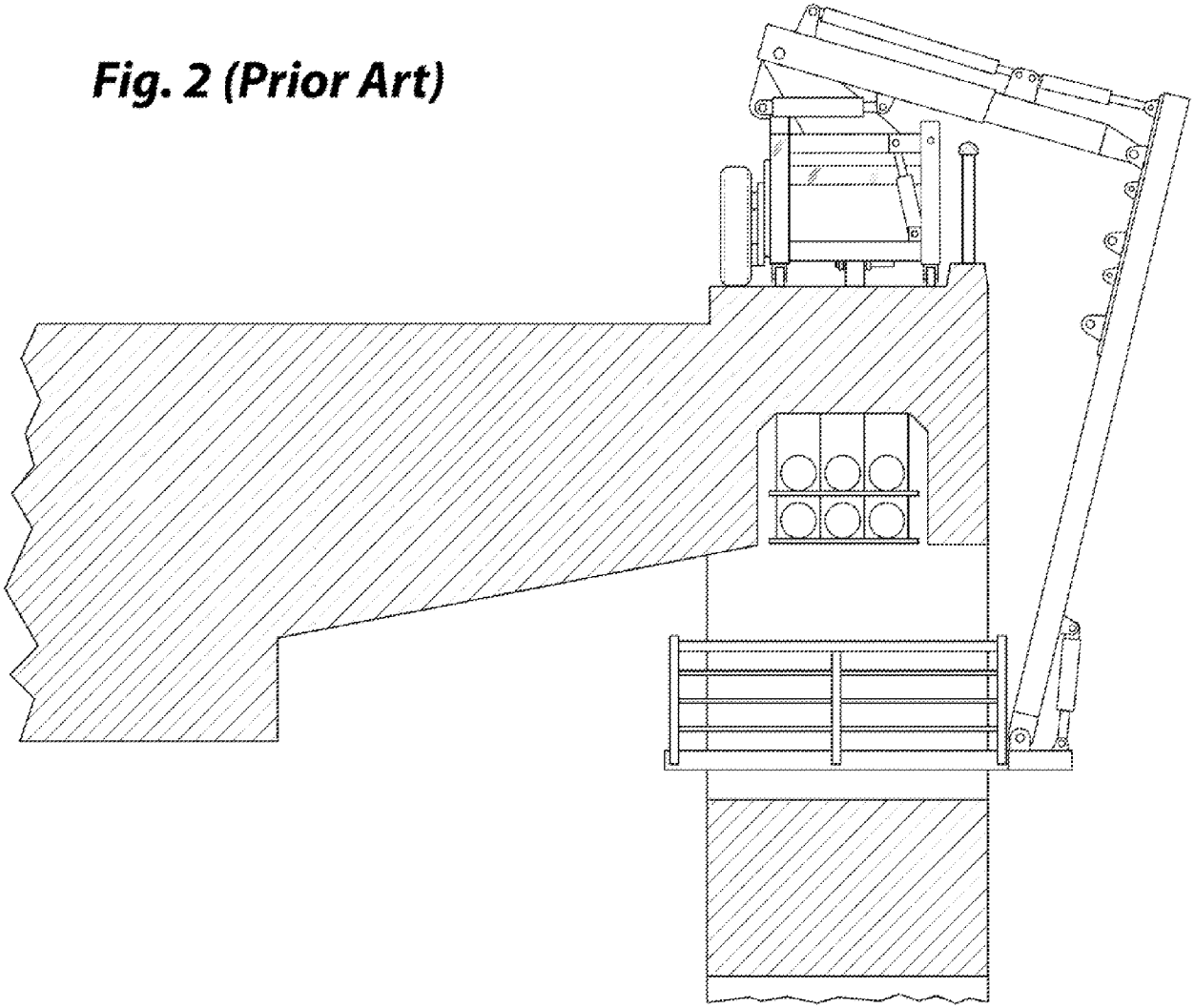
Fig. 2 (Prior Art)
FIG. 2 (Prior Art) illustrates the additional disadvantages of the prior art.
Figure 3A:
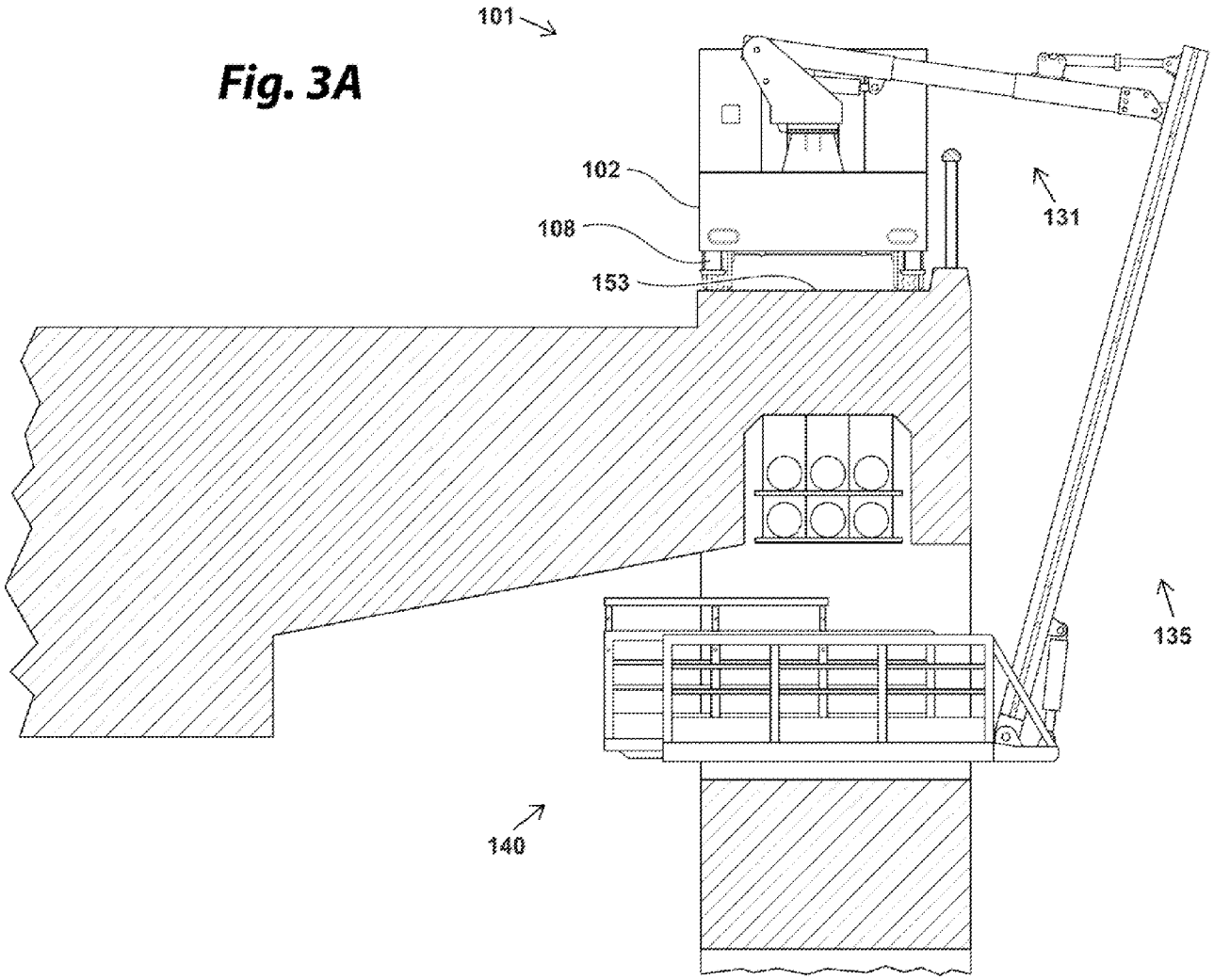
FIGS. 3A, 3B, 3C, 3D, 3E, 3F, and 3G illustrate the unique roadworthy trailer, having anti-slip safety deck, independently-adjustable trailer-leveling motorized legs, built-in-pneumatic-tool compressor, on-site-extendable-interchangeable boom assembly, on-site-extendable-interchangeable ladder assembly, on-site-extendable-interchangeable catwalk assembly, and telescopic safety-handrail assembly.
Figure 3B:
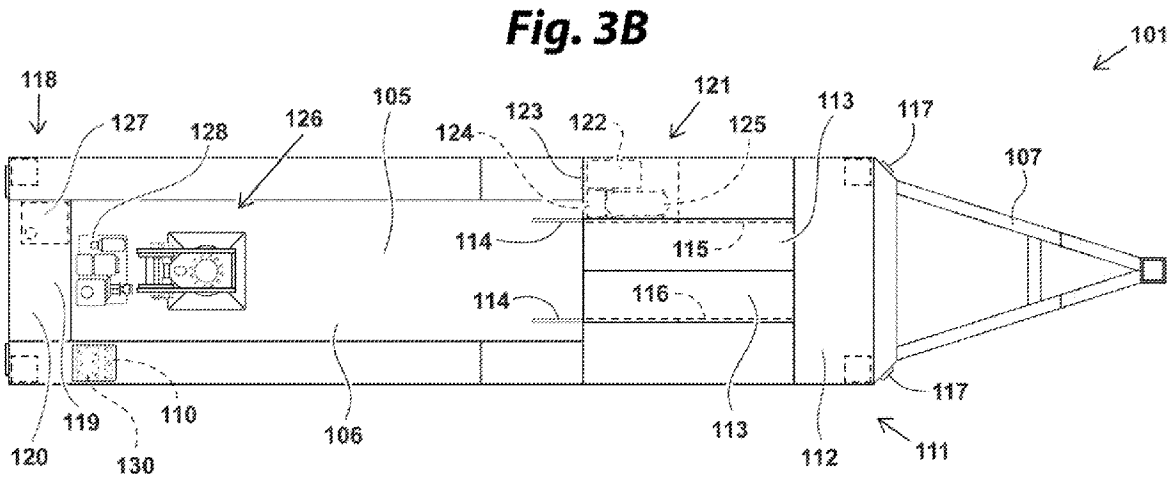
Figure 3C:
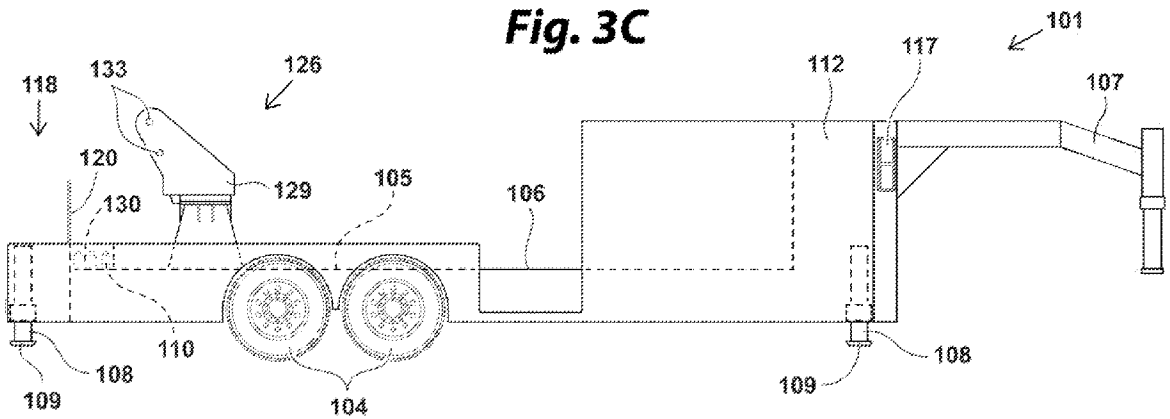
Figure 3D:
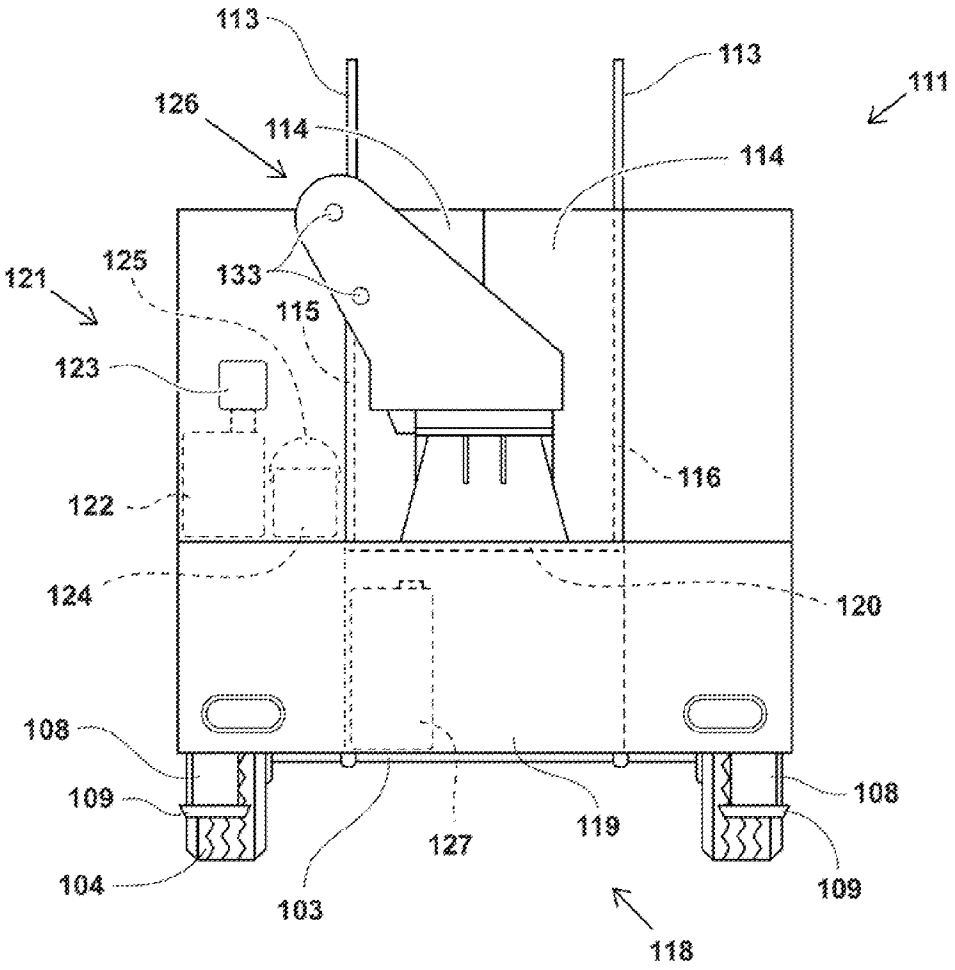
Figure 3G:
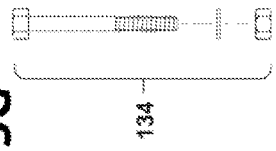
Figure 3F:
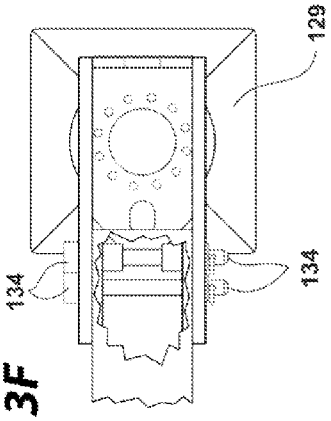
Figure 3E:
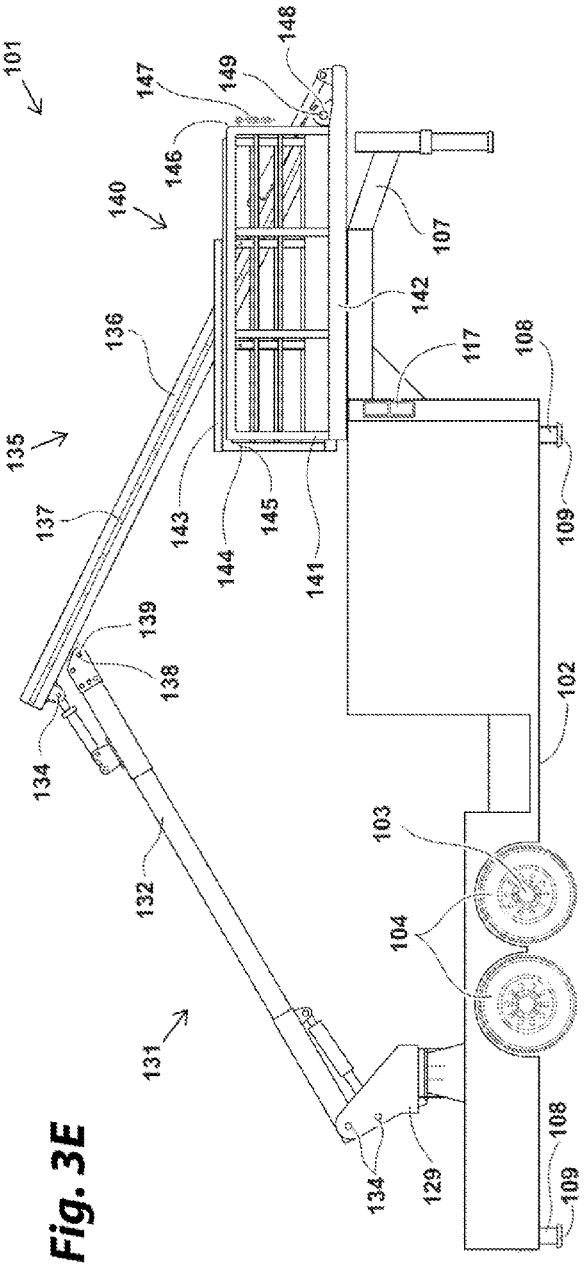
Figure 4:
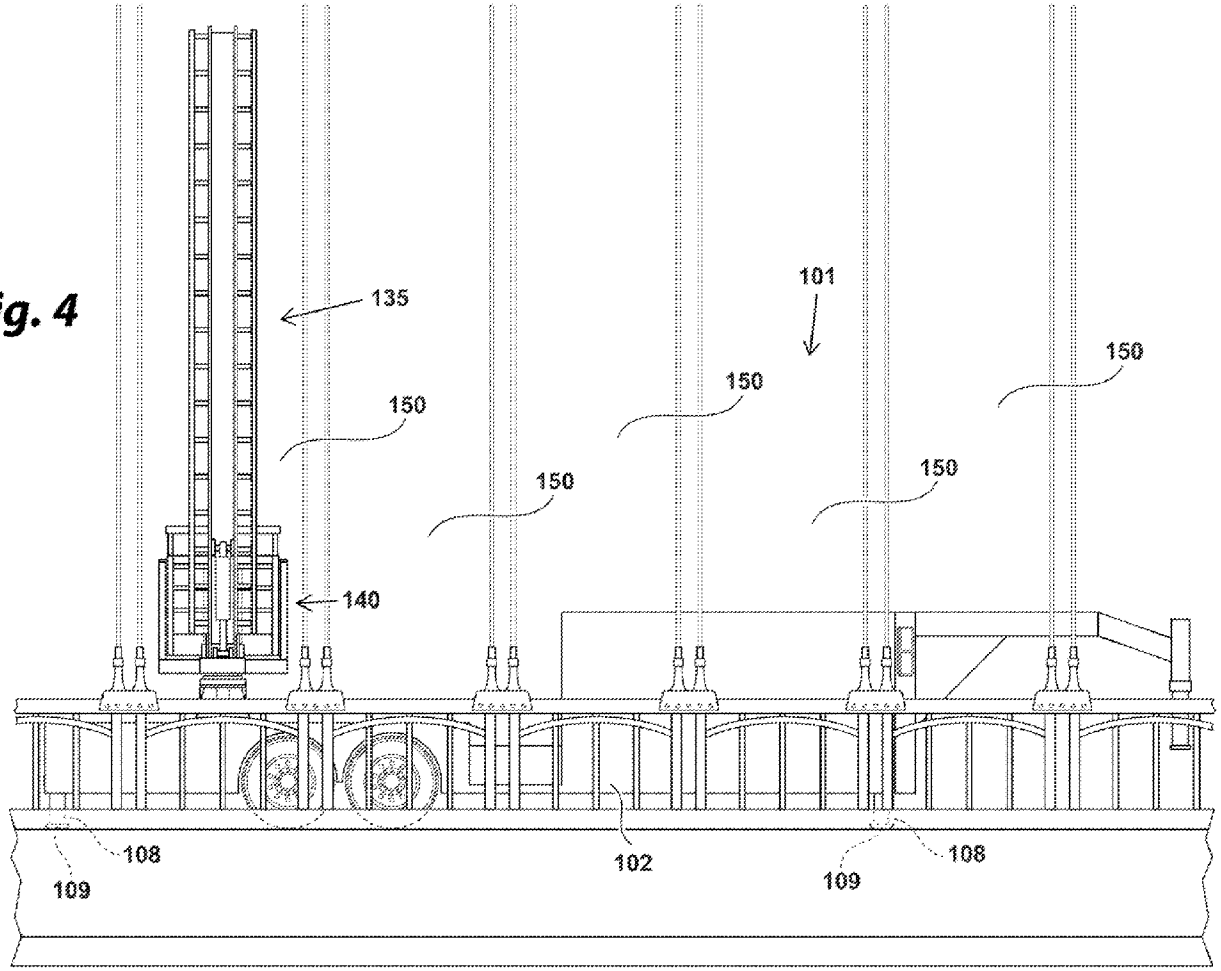
FIG. 4 illustrates how the extendable interchangeable telescopic-safety-handrail catwalk system can lift and shift equipment and personnel through a narrow gap less than 30 inches wide between two cables of a suspensions-cable-type bridge.

A unique roadworthy boom trailer comprises a roadworthy wheeled chassis, four independently-adjustable trailer-leveling motorized legs attached to the bottom of the chassis, pneumatic-tool compressor built in the chassis, turret assembly attached to the top of the chassis, and on-site-extendable-interchangeable quick-release assemblies of boom, ladder, and catwalk rotatably attached to the turret assembly. The ladder assembly has safety rungs for safety cables to be hooked thereon. The catwalk assembly has adjustable telescopic safety handrails. The unique roadworthy boom trailer can work with suspension-cable-or-truss-type bridges, low-or-high-power-line bridges, short-or-tall-supporting-column bridges, single-or-multiple-lane bridges, and regular-or-railroad bridges. The catwalk assembly can have multiple additional catwalk assemblies attached thereto to extend its width or length to generally equal the width or length of a bridge, respectively. The catwalk assembly is sized to operate entirely within the width of a sidewalk, and to lift and shift equipment and personnel through narrow openings or into nooks both over and under bridges.

DETAILED DESCRIPTION OF THE INVENTION

Component

Referring to FIGS. 3A, 3B, 3C, 3D, 3E, 3F, and 3G, the unique built-in-pneumatic-tool-compressor on-site-extendable-interchangeable-boom on-site-extendable-interchangeable-ladder on-site-extendable-interchangeable-catwalk roadworthy-wheel-and-tire trailer comprises:

1) A roadworthy independently-adjustable-corner-height boom trailer system 101, comprising:
2) A trailer chassis 102,
3) Wheel axles 103,
4) Multiple wheels and tires 104,
5) An anti-slip safety deck 105,
6) An anti-slip safety coating 106,
7) Adjustable towing goose-neck tongue 107, 8) Four independently-adjustable trailer-leveling motorized legs 108,
9) Four motorized-leg bases 109,
10) A motorized-leg remote control 110;
11) A front utility watertight vault system 111, comprising:
12) A front utility watertight vault 112,
13) Lockable top-safety-access watertight doors 113,
14) Lockable interior-safety-access watertight doors 114,
15) Lockable left-safety-access watertight doors 115,
16) Lockable right-safety-access watertight doors 116,
17) Stop-and-go-indicator safety lights 117;
18) A rear utility watertight vault system 118, comprising:
19) A rear utility watertight vault 119,
20) Lockable rear-safety-access watertight door 120;
21) A convenient pneumatic-tool compressor system 121, comprising:
22) A convenient-pneumatic-tool fuel tank 122,
23) A convenient-pneumatic-tool fuel-filler 123,
24) A convenient-pneumatic-tool generator 124,
25) A convenient-pneumatic-tool compressor 125;
26) A stabilized quick-action turret system 126, comprising:
27) A quick-action-turret fuel tank 127,
28) A quick-action-turret motor 128,
29) A quick-action-turret assembly 129,
30) A quick-action-turret remote control 130;
31) Extendable interchangeable quick-release boom system 131, comprising:
32) An extendable interchangeable quick-release boom assembly 132,
33) Quick-release-boom-assembly pin holes 133,
34) Quick-release-boom-assembly pins 134;
35) Extendable interchangeable quick-release safety-cable-rung ladder system 135, comprising:
36) An extendable interchangeable quick-release ladder assembly 136,
37) Safety-cable-attaching rungs 137,
38) Quick-release-ladder-assembly pin holes 138,
39) Quick-release-ladder-assembly pins 139; and
40) Extendable interchangeable telescopic-safety-handrail catwalk system 140, comprising:
41) An extendable interchangeable anti-slip-grid catwalk assembly 141,
42) Safety footwalls 142,
43) Telescopic safety-handrail assembly 143,
44) Telescopic-safety-handrail-assembly adjustable holes 144,
45) Telescopic-safety-handrail-assembly adjustable pins 145,
46) Telescopic-safety-handrail-catwalk-assembly entry 146,
47) Telescopic-safety-handrail-catwalk-assembly chain 147;
48) Quick-release-catwalk-assembly pin holes 148,
49) Quick-release-catwalk-assembly pins 149.

Material

Referring to FIGS. 3A, 3B, 3C, 3D, 3E, 3F, and 3G:

1) Roadworthy independently-adjustable-corner-height boom trailer system 101 is made of combined materials of its components.
2) Trailer chassis 102 is made of metallic material.
3) Wheels axles 103 each are made of metallic material.
4) Multiple wheels and tires 104 each are made of metallic and rubber materials.
5) Anti-slip safety deck 105 is made of metallic material.
6) Anti-slip safety coating 106 is made of abrasive granular material.
7) Adjustable towing goose-neck tongue 107 is made of metallic material.
8) Four independently-adjustable trailer-leveling motorized legs 108 each are made of metallic material.
9) Four motorized-leg bases 109 each are made of metallic material.
10) Motorized-leg remote control 110 is made of metallic and plastic materials.
11) Front utility watertight vault system 111 is made of combined materials of its components.
12) Front utility watertight vault 112 is made of metallic material.
13) Lockable top-safety-access watertight doors 113 each are made of metallic material.
14) Lockable interior-safety-access watertight doors 114 each are made of metallic material.
15) Lockable left-safety-access watertight doors 115 are made of metallic material.
16) Lockable right-safety-access watertight doors 116 each are made of metallic material.
17) Stop-and-go-indicator safety lights 117 each are made of plastic, glass, and metallic materials.
18) Rear utility watertight vault system 118 is made of combined materials of its components.
19) Rear utility watertight vault 119 is made of metallic material.
20) Lockable rear-safety-access watertight door 120 is made of metallic material.
21) Convenient pneumatic-tool compressor system 121 is made of combined materials of its components.
22) Convenient-pneumatic-tool fuel tank 122 is made of metallic material.
23) Convenient-pneumatic-tool fuel-filler 123 is made of metallic material.
24) Convenient-pneumatic-tool generator 124 is made of metallic material.
25) Convenient-pneumatic-tool compressor 125 is made of metallic material.
26) Stabilized quick-action turret system 126 is made of combined materials of its components.
27) Quick-action-turret fuel tank 127 is made of metallic material.
28) Quick-action-turret motor 128 is made of metallic material.
29) Quick-action-turret assembly 129 is made of metallic material.
30) Quick-action-turret remote control 130 is made of metallic material.
31) Extendable interchangeable quick-release boom system 131 is made of combined materials of its components.
32) Extendable interchangeable quick-release boom assembly 132 is made of metallic material.
33) Quick-release-boom-assembly pin holes 133 each are made of empty space.
34) Quick-release-boom-assembly pins 134 each are made of metallic material.
35) Extendable interchangeable quick-release safety-cable-rung ladder system 135 is made of combined materials of its components.
36) Extendable interchangeable quick-release ladder assembly 136 is made of metallic material.
37) Safety-cable-attaching rungs 137 each are made of metallic material.
38) Quick-release-ladder-assembly pin holes 138 each are made of empty space.
39) Quick-release-ladder-assembly pins 139 each are made of metallic material.

40) Extendable interchangeable telescopic-safety-handrail catwalk system 140 is made of combined materials of its components.
41) Extendable interchangeable anti-slip-grid catwalk assembly 141 is made of metallic material.
42) Safety footwalls 142 each are made of metallic material.
43) Telescopic safety-handrail assembly 143 is made of metallic material.
44) Telescopic-safety-handrail-assembly adjustable holes 144 each are made of empty space.
45) Telescopic-safety-handrail-assembly adjustable pins 145 each are made of metallic material.
46) Telescopic-safety-handrail-catwalk-assembly entry 146 is made of empty space.
47) Telescopic-safety-handrail-catwalk-assembly chain 147 is made of metallic material;
48) Quick-release-catwalk-assembly pin holes 148 each are made of empty space.
49) Quick-release-catwalk-assembly pins 149 each are made of metallic material.

Shape

Referring to FIGS. 3A, 3B, 3C, 3D, 3E, 3F, and 3G:

1) A roadworthy independently-adjustable-corner-height boom trailer system 101 has a combined shape of its components.
2) Trailer chassis 102 has a rectangular shape.
3) Wheels axles 103 each have a cylindrical shape.
4) Multiple wheels and tires 104 each have a circular shape.
5) Anti-slip safety deck 105 has a rectangular shape.
6) Anti-slip safety coating 106 has a flat shape.
7) Adjustable towing goose-neck tongue 107 has a triangular goose-neck shape.
8) Four independently-adjustable trailer-leveling motorized legs 108 each have an elongated shape with a square cross-section.
9) Four motorized-leg bases 109 each have a square shape.
10) A motorized-leg remote control 110 has a rectangular shape.
11) A front utility watertight vault system 111 has a combined shape of its components.
12) A front utility watertight vault 112 has a U shape.
13) Lockable top-safety-access watertight doors 113 each have a rectangular shape.
14) Lockable interior-safety-access watertight doors 114 each have a rectangular shape.
15) Lockable left-safety-access watertight doors 115 each have a rectangular shape.
16) Lockable right-safety-access watertight doors 116 each have a rectangular shape.
17) Stop-and-go-indicator safety lights 117 each have a rectangular shape.
18) A rear utility watertight vault system 118 has a combined shape of its components.
19) A rear utility watertight vault 119 has a rectangular shape.
20) Lockable rear-safety-access watertight door 120 has a rectangular shape.
21) A convenient pneumatic-tool compressor system 121 has a combined shape of its components.
22) A convenient-pneumatic-tool fuel tank 122 has a rectangular shape.
23) A convenient-pneumatic-tool fuel-filler 123 has a circular-tube shape.
24) A convenient-pneumatic-tool generator 124 has a cylindrical shape.
25) A convenient-pneumatic-tool compressor 125 has a cylindrical shape.
26) A stabilized quick-action turret system 126 has a combined shape of its components.
27) A quick-action-turret fuel tank 127 has a rectangular shape.
28) A quick-action-turret motor 128 has a cylindrical shape.
29) A quick-action-turret assembly 129 has a frustum shape.
30) A quick-action-turret remote control 130 has a rectangular shape.
31) Extendable interchangeable quick-release boom system 131 has a combined shape of its components.
32) An extendable interchangeable quick-release boom assembly 132 has an elongated shape.
33) Quick-release-boom-assembly pin holes 133 each have a round shape.
34) Quick-release-boom-assembly pins 134 each have a rod shape.
35) Extendable interchangeable quick-release safety-cable-rung ladder system 135 has a combined shape of its components.
36) An extendable interchangeable quick-release ladder assembly 136 has an elongated rectangular shape.
37) Safety-cable-attaching rungs 137 each have a cylindrical shape.
38) Quick-release-ladder-assembly pin holes 138 each have a round shape.
39) Quick-release-ladder-assembly pins 139 each have a rod shape.
40) An extendable interchangeable telescopic-safety-handrail catwalk system 140 has a combined shape of its components.
41) An extendable interchangeable anti-slip-grid catwalk assembly 141 has a rectangular shape.
42) Safety footwalls 142 each have a rectangular shape.
43) Telescopic safety-handrail assembly 143 has a telescopic U shape.
44) Telescopic-safety-handrail-assembly adjustable holes 144 each have a round shape.
45) Telescopic-safety-handrail-assembly adjustable pins 145 each have a rod shape.
46) Telescopic-safety-handrail-catwalk-assembly entry 146 has a rectangular shape.
47) Telescopic-safety-handrail-catwalk-assembly chain 147 has a chain shape.
48) Quick-release-catwalk-assembly pin holes 148 each have a round shape.
49) Quick-release-catwalk-assembly pins 149 each have a rod shape.

Connection

Referring to FIGS. 3A, 3B, 3C, 3D, 3E, 3F, and 3G:

1) Roadworthy independently-adjustable-corner-height boom trailer system 101 is attached to front utility watertight vault system 111 and rear utility watertight vault system 118.
2) Trailer chassis 102 is attached to wheels axles 103.
3) Wheel axles 103 each are rotatably attached to the underside of trailer chassis 102.
4) Multiple wheels and tires 104 each are rotatably bolted to wheel axles 103.
5) Anti-slip safety deck 105 is welded to the upper side of trailer chassis 102.
6) Anti-slip safety coating 106 is adhered to anti-slip safety deck 105.
7) Adjustable towing goose-neck tongue 107 is welded to the front of trailer chassis 102.
8) Four independently-adjustable trailer-leveling motorized legs 108 each are telescopically attached to one corner of the underside of trailer chassis 102.

9) Four motorized-leg bases 109 each are welded to one independently-adjustable trailer-leveling motorized leg 108.

10) Motorized-leg remote control 110 is attached to trailer chassis 102.

11) Front utility watertight vault system 111 is attached to trailer chassis 102.

12) Front utility watertight vault 112 is welded to trailer chassis 102.

13) Lockable top-safety-access watertight doors 113 each are hingedly connected to front utility watertight vault 112.

14) Lockable interior-safety-access watertight doors 114 each are hingedly connected to front utility watertight vault 112.

15) Lockable left-safety-access watertight doors 115 each are hingedly connected to front utility watertight vault 112.

16) Lockable right-safety-access watertight doors 116 each are hingedly connected to front utility watertight vault 112.

17) Stop-and-go-indicator safety lights 117 each are attached to front utility watertight vault 112.

18) Rear utility watertight vault system 118 is attached to trailer chassis 102.

19) Rear utility watertight vault 119 is welded to trailer chassis 102.

20) Lockable rear-safety-access watertight door 120 is hingedly connected to rear utility watertight vault 119.

21) Convenient pneumatic-tool compressor system 121 is attached to trailer chassis 102.

22) Convenient-pneumatic-tool fuel tank 122 is attached to trailer chassis 102.

23) Convenient-pneumatic-tool fuel-filler 123 is seamlessly attached to trailer system 101 or vault system 111 on driver's side for safety when refueling fuel tank 122.

24) Convenient-pneumatic-tool generator 124 is attached to trailer chassis 102.

25) Convenient-pneumatic-tool compressor 125 is attached to trailer chassis 102.

26) Stabilized quick-action turret system 126 is attached to trailer chassis 102.

27) Quick-action-turret fuel tank 127 is attached to trailer chassis 102.

28) Quick-action-turret motor 128 is attached to trailer chassis 102.

29) Quick-action-turret assembly 129 is rotatably attached to trailer chassis 102 and quick-action-turret motor 128.

30) Quick-action-turret remote control 130 is attached to quick-action-turret assembly 129 or trailer chassis 102.

31) Extendable interchangeable quick-release boom system 131 is interchangeably attached to stabilized quick-action turret system 126.

32) Extendable interchangeable quick-release boom assembly 132 is interchangeably attached to quick-action-turret assembly 129.

33) Quick-release-boom-assembly pin holes 133 each are drilled into one end of extendable interchangeable quick-release boom assembly 132.

34) Quick-release-boom-assembly pins 134 each are inserted through one quick-release-boom-assembly pin hole 133.

35) Extendable interchangeable quick-release safety-cable-rung ladder system 135 is interchangeably attached to extendable interchangeable quick-release boom system 131.

36) Extendable interchangeable quick-release ladder assembly 136 is interchangeably attached to another end of extendable interchangeable quick-release boom assembly 132.

37) Safety-cable-attaching rungs 137 each are welded to extendable interchangeable quick-release ladder assembly 136.

38) Quick-release-ladder-assembly pin holes 138 each are drilled into one end of extendable interchangeable quick-release ladder assembly 136.

39) Quick-release-ladder-assembly pins 139 each are inserted through one quick-release-ladder-assembly pin hole 138.

40) Extendable interchangeable telescopic-safety-handrail catwalk system 140 is interchangeably attached to extendable interchangeable quick-release safety-cable-rung ladder system 135.

41) Extendable interchangeable anti-slip-grid catwalk assembly 141 is attached to extendable interchangeable quick-release ladder assembly 136.

42) Safety footwalls 142 each are welded to the floor perimeter of extendable interchangeable anti-slip-grid catwalk assembly 141.

43) Telescopic safety-handrail assembly 143 is telescopically and adjustably connected to extendable interchangeable anti-slip-grid catwalk assembly 141.

44) Telescopic-safety-handrail-assembly adjustable holes 144 each are drilled into telescopic safety-handrail assembly 143.

45) Telescopic-safety-handrail-assembly adjustable pins 145 each are inserted through one telescopic-safety-handrail-assembly adjustable hole 144.

46) Telescopic-safety-handrail-catwalk-assembly entry 146 is built into extendable interchangeable anti-slip-grid catwalk assembly 141.

47) Telescopic-safety-handrail-catwalk-assembly chain 147 is attached to one side of telescopic-safety-handrail-catwalk-assembly entry 146.

48) Quick-release-catwalk-assembly pin holes 148 each are drilled into one end of extendable interchangeable anti-slip-grid catwalk assembly 141.

49) Quick-release-catwalk-assembly pins 149 each are inserted through one quick-release-catwalk-assembly pin hole 148.

Function

Figure 6A:
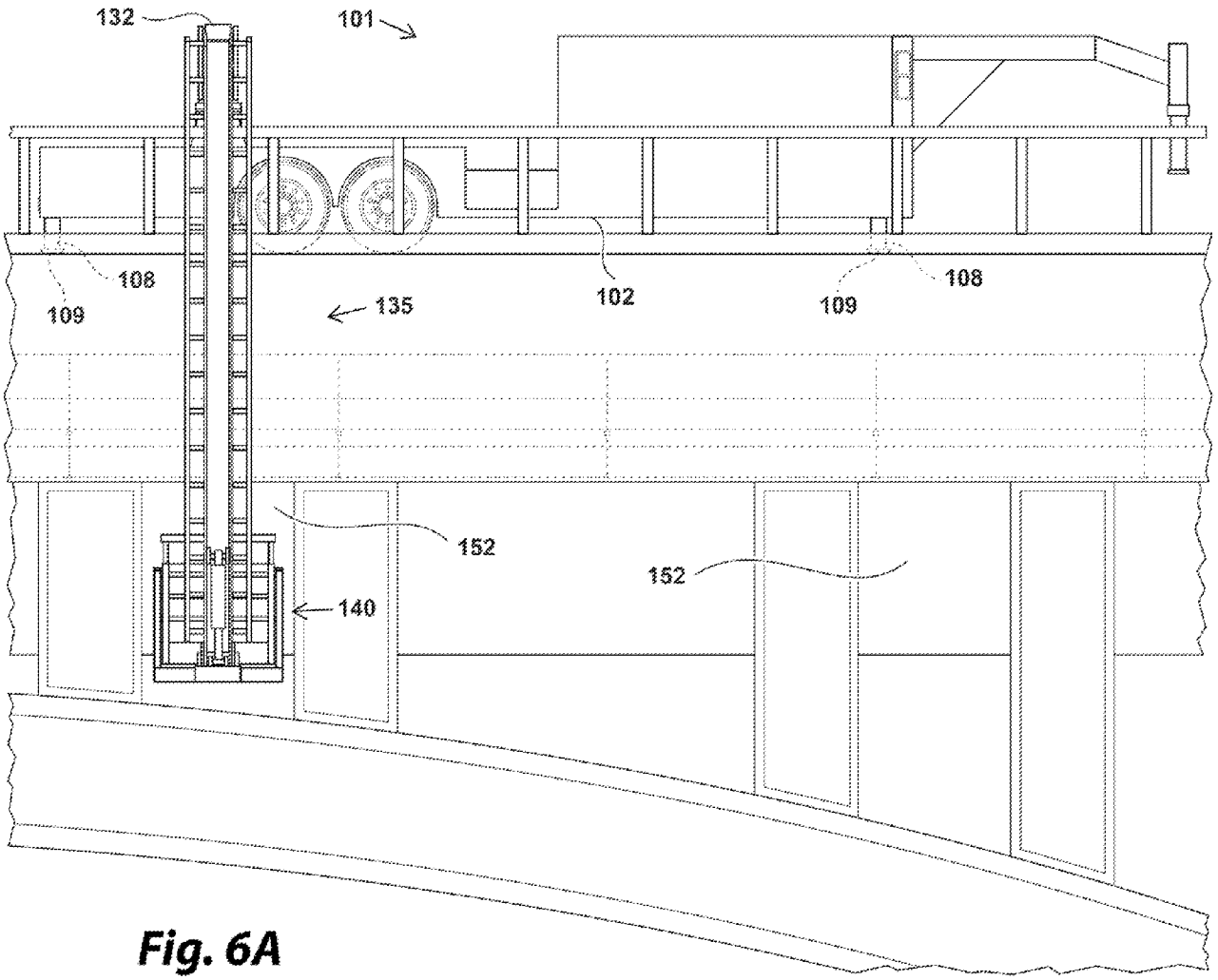
FIGS. 6A and 6B illustrate how the extendable interchangeable telescopic-safety-handrail catwalk system can lift and shift equipment and personnel through a narrow nook less than 30 inches wide between two posts of a column-type bridge.
Figure 6B:
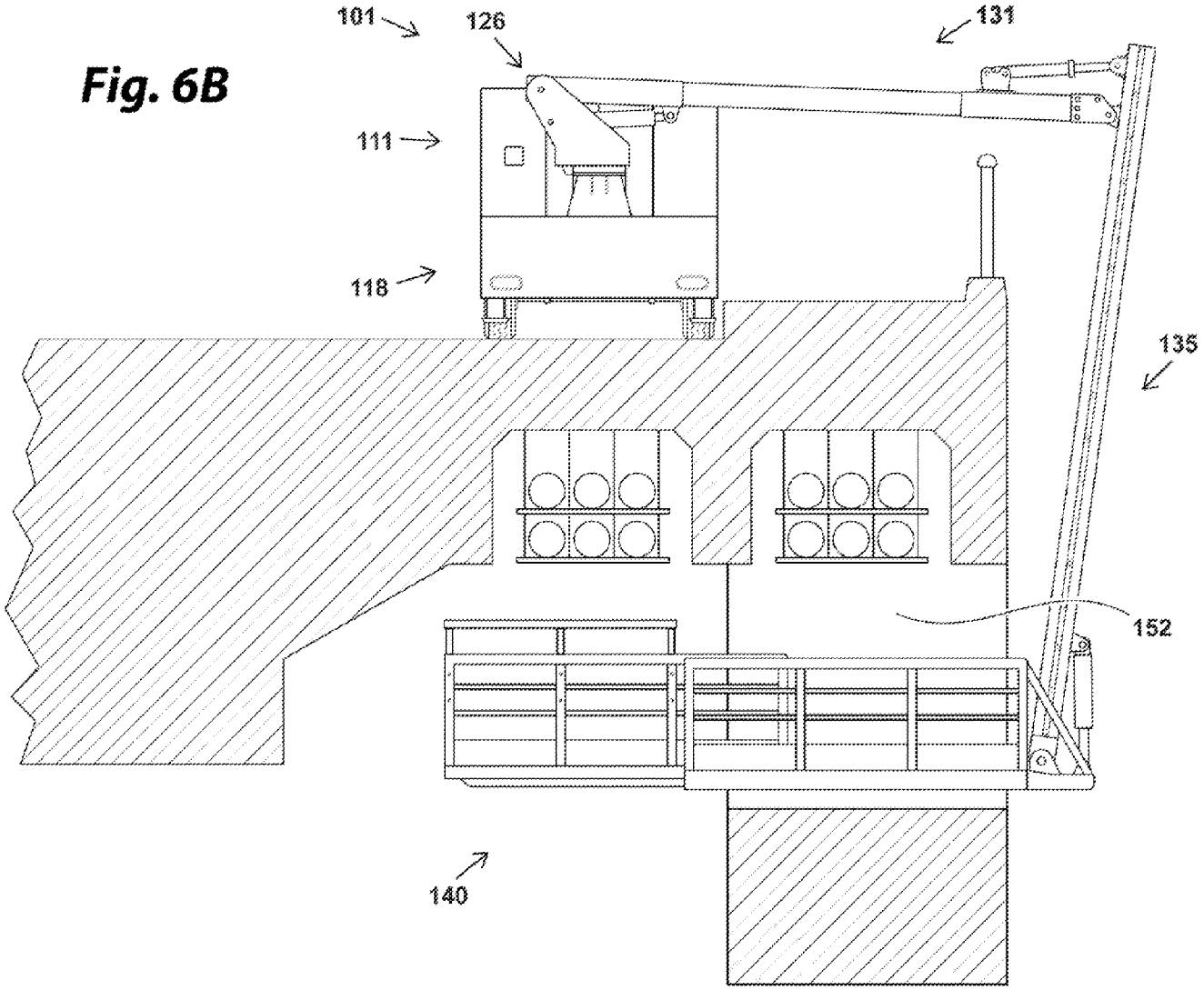

Referring to FIGS. 4, 5, 6A, 6B, 7A, and 7B:

1) Roadworthy independently-adjustable-corner-height boom trailer system 101 is for:

a) Providing a roadworthy, compact, and stable platform to securely mount thereon and conveniently transport extendable interchangeable quick-release boom system 131, extendable interchangeable quick-release safety-cable-rung ladder system 135, and extendable interchangeable telescopic-safety-handrail catwalk system 140, which can lift and shift equipment and personnel through narrow openings over and under bridges (for example, through a less-than-30-inch-wide opening 150 between two cables of a small suspension-cable-type bridge (FIG. 4) or through a less-than-30-inch-wide opening 151 between two posts of a small truss-type bridge (FIG. 5), and can maneuver and work in small areas, nooks, and crannies (for example, in a less-than-30-inch-wide nook 152 (FIGS. 6A and 6B) over and under:

small and large suspension-cable-type bridges (suspension bridges), small and large truss-type bridges, small and large low-power-line bridges,
small and large high-power-line bridges,
small and large short-supporting-column bridges,
small and large tall-supporting-column bridges,
small and large single-lane bridges,
small and large multiple-lane bridges,
small and large regular bridges, and
small and large rail-road bridges;

b) Providing a platform with four independently-adjustable trailer-leveling motorized legs 108 to level trailer chassis 102 when situated on uneven terrain (FIG. 6A);

c) Providing motorized-leg remote control 110; and d) Providing a safe, non-slip working platform.

2) Trailer chassis 102 is for providing a platform upon which stabilized quick-action turret system 126 can be securely mounted.

3) Wheels axles 103 each are for rotatably securing multiple wheels and tires 104 to trailer chassis 102.

4) Multiple wheels and tires 104 each are for allowing roadworthy independently-adjustable-corner-height boom trailer system 101 to move on a road.

5) Anti-slip safety deck 105 is for providing a safe, convenient working area.

6) Anti-slip safety coating 106 is for providing a safe, non-slip working surface.

7) Adjustable towing goose-neck tongue 107 is for attaching trailer chassis 102 to a motorized vehicle.

8) Four independently-adjustable trailer-leveling motorized legs 108 each are for independently providing adjustable height, to level trailer chassis 102 when situated on uneven terrain.

9) Four motorized-leg bases 109 each are for providing a stable base on the ground for one of four independently-adjustable trailer-leveling motorized legs 108.

10) Motorized-leg remote control 110 is for conveniently adjusting the height of independently-adjustable trailer-leveling motorized legs 108.

11) Front utility watertight vault system 111 is for:

a) Providing safe interior access to tools and equipment, away from traffic, and b) Providing locked water-tight storage for tools and equipment.

12) Front utility watertight vault 112 is for providing safe interior access to tools and equipment away from traffic.

13) Lockable top-safety-access watertight doors 113 each are for providing a lockable, water-tight barrier, and a safe, convenient working surface.

14) Lockable interior-safety-access watertight doors 114 each are for providing a lockable, water-tight barrier, and a safe, convenient working surface.

15) Lockable left-safety-access watertight doors 115 each are for providing a lockable, water-tight barrier, and a safe, convenient working surface.

16) Lockable right-safety-access watertight doors 116 each are for providing a lockable, water-tight barrier, and a safe, convenient working surface.

17) Stop-and-go-indicator safety lights 117 each are for providing a safe, clear communication means for vehicle movement readiness between boom operator and driver.

18) Rear utility watertight vault system 118 is for:

a) Providing safe interior access to tools and equipment, away from traffic, and b) Providing locked water-tight storage for tools and equipment.

19) Rear utility watertight vault 119 is providing safe access to tools and equipment.

20) Lockable rear-safety-access watertight door 120 is for providing a lockable, water-tight barrier, and a safe, convenient working surface.

21) Convenient pneumatic-tool compressor system 121 is for providing convenient, on-board compressed air to operate pneumatic tools.

22) Convenient-pneumatic-tool fuel tank 122 is for holding fuel for convenient-pneumatic-tool generator 124.

23) Convenient-pneumatic-tool fuel-filler 123 is for providing safe, convenient access for filling convenient-pneumatic-tool fuel tank 122.

24) Convenient-pneumatic-tool generator 124 is for providing electricity for operating convenient-pneumatic-tool compressor 125.

25) Convenient-pneumatic-tool compressor 125 is for providing compressed air for operating pneumatic-tools.

26) Stabilized quick-action turret system 126 is for anchoring extendable interchangeable quick-release boom system 131, extendable interchangeable quick-release safety-cable-rung ladder system 135, and extendable interchangeable telescopic-safety-handrail catwalk system 140 to trailer chassis 102, and for rotating them.

27) Quick-action-turret fuel tank 127 is for holding fuel for quick-action-turret motor 128.

28) Quick-action-turret motor 128 is for rotating quick-action-turret assembly 129.

29) Quick-action-turret assembly 129 is for rotating extendable interchangeable quick-release boom system 131, extendable interchangeable quick-release safety-cable-rung ladder system 135, and extendable interchangeable telescopic-safety-handrail catwalk system 140.

30) Quick-action-turret remote control 130 is for conveniently controlling the rotation of extendable interchangeable quick-release boom system 131, extendable interchangeable quick-release safety-cable-rung ladder system 135, and extendable interchangeable telescopic-safety-handrail catwalk system 140.

31) Extendable interchangeable quick-release boom system 131 is for:

a) Coupling quick-action-turret assembly 129 to extendable interchangeable quick-release ladder assembly 136, and b) Extending the reach of extendable interchangeable quick-release ladder assembly 136.

32) Extendable interchangeable quick-release boom assembly 132 is for extending the reach of and enabling the movement of extendable interchangeable quick-release ladder assembly 136.

33) Quick-release-boom-assembly pin holes 133 each are for one quick-release-boom-assembly pin 134 to be inserted therethrough.

34) Quick-release-boom-assembly pins 134 each are for being inserted through one quick-release-boom-assembly pin hole 133 to quickly and releasably couple quick-action-turret assembly 129 to extendable interchangeable quick-release boom assembly 132, to provide convenient on-site interchangeability.

35) Extendable interchangeable quick-release safety-cable-rung ladder system 135 is for:

a) Coupling extendable interchangeable quick-release boom assembly 132 to extendable interchangeable anti-slip-grid catwalk assembly 141, and b) Extending the reach of extendable interchangeable anti-slip-grid catwalk assembly 141.

36) Extendable interchangeable quick-release ladder assembly 136 is for extending the reach of and enabling the movement of extendable interchangeable anti-slip-grid catwalk assembly 141.

37) Safety-cable-attaching rungs 137 each are for safety cables, yoyos, fall arrest systems, and/or lanyards to be attached thereto for added safety and maneuverability of workers.

38) Quick-release-ladder-assembly pin holes 138 each are for one quick-release-ladder-assembly pin 139 to be inserted therethrough.

39) Quick-release-ladder-assembly pins 139 each are for being inserted through one quick-release-ladder-assembly pin hole 138, to quickly and releasably couple extendable interchangeable quick-release boom assembly 132 to extendable interchangeable quick-release ladder assembly 136, to provide convenient on-site interchangeability.

40) Extendable interchangeable telescopic-safety-handrail catwalk system 140 is for:

a) Providing a telescopic, height-adjustable safety handrail, b) Providing a safe, anti-slip interchangeable working platform, and c) Providing safety barriers for feet, legs, and bodies.

41) Extendable interchangeable anti-slip-grid catwalk assembly 141 is for providing a safe, interchangeable working platform.

42) Safety footwalls 142 each are for providing a safety barrier.

43) Telescopic safety-handrail assembly 143 (FIGS. 7A and 7B) is for providing a height-adjustable safety handrail for workers to lean on and hold on while working, for added safety.

44) Telescopic-safety-handrail-assembly adjustable holes 144 each are for one telescopic-safety-handrail-assembly adjustable pin 145 to be inserted therethrough.

45) Telescopic-safety-handrail-assembly adjustable pins 145 each are for being inserted through one telescopic-safety-handrail-assembly adjustable hole 144 to adjust the height of telescopic safety-handrail assembly 143.

46) Telescopic-safety-handrail-catwalk-assembly entry 146 is for providing an easy entry into extendable interchangeable anti-slip-grid catwalk assembly 141.

47) Telescopic-safety-handrail-catwalk-assembly chain 147 is for providing a safety barrier.

48) Quick-release-catwalk-assembly pin holes 148 each are for one quick-release-catwalk-assembly pin 149 to be inserted therethrough.

49) Quick-release-catwalk-assembly pins 149 each are for being inserted through one quick-release-catwalk-assembly pin hole 148, to quickly and releasably couple extendable interchangeable quick-release ladder assembly 136 to extendable interchangeable anti-slip-grid catwalk assembly 141, to provide convenient on-site interchangeability.

Operation

Referring to FIGS. 3A, 4, 5, 6A, 6B, 7A, and 7B, the unique built-in-pneumatic-tool-compressor on-site-extendable-interchangeable-boom on-site-extendable-interchangeable-ladder on-site-extendable-interchangeable-catwalk roadworthy-wheel-and-tire trailer, comprises:

Bridge Maintenance

Figure 5:
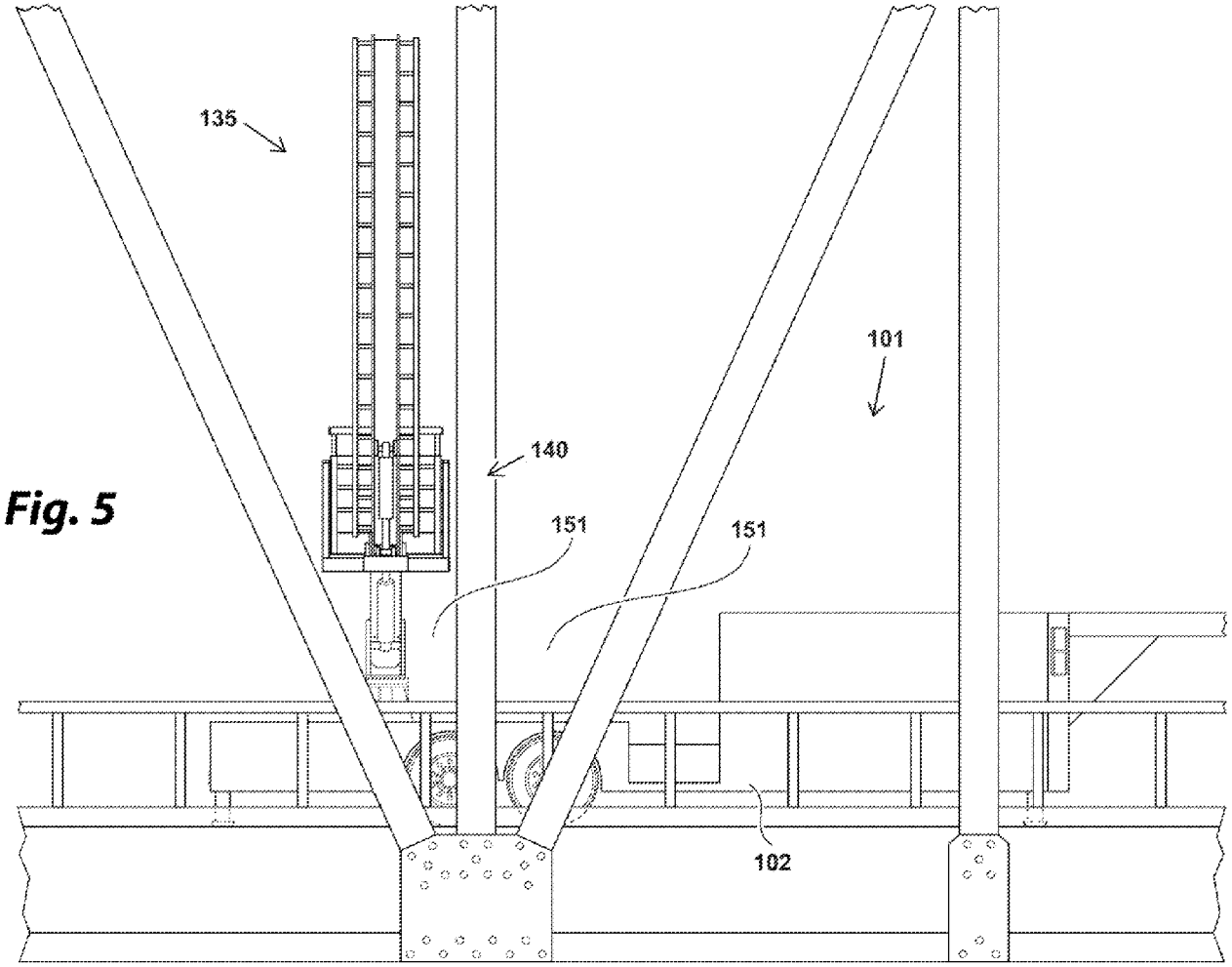
FIG. 5 illustrates how the extendable interchangeable telescopic-safety-handrail catwalk system can lift and shift equipment and personnel through a narrow nook less than 30 inches wide between two posts of a truss-type bridge.
Figure 7A:
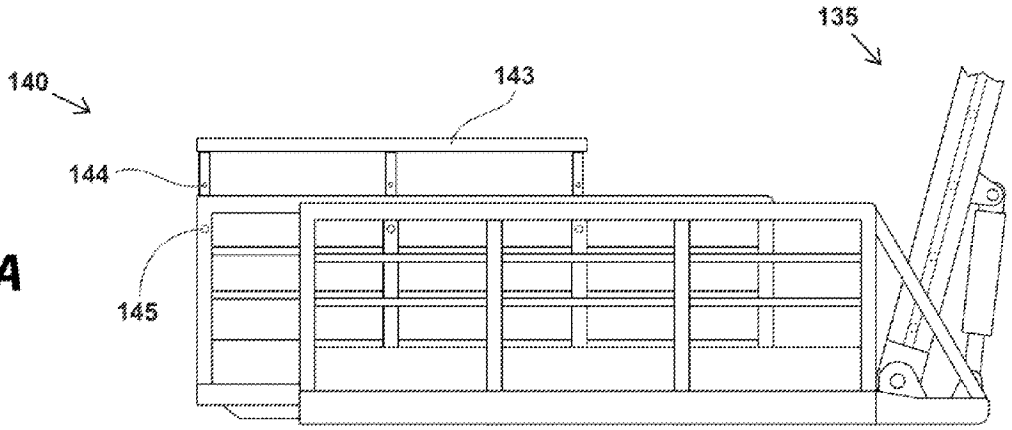
FIGS. 7A and 7B illustrate how the telescopic safety-handrail assembly is vertically extended and secured.
Figure 7B:
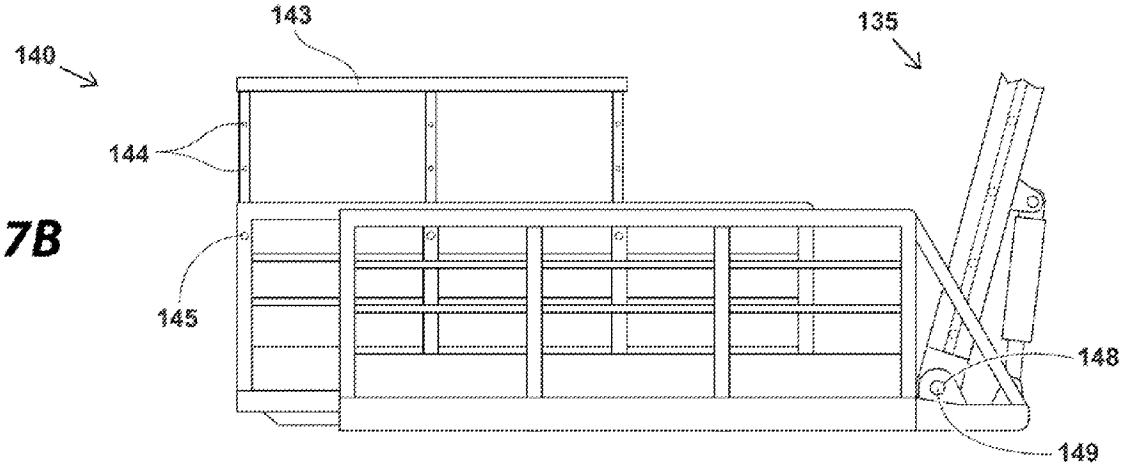

1) Towing the unique trailer to a:
suspension-cable-type bridge,
truss-type bridge,
low-power-line bridge,
high-power-line bridge,
short-supporting-column bridge,
tall-supporting-column bridge,
single-lane bridge,
multiple-lane bridge,
regular bridge, or
rail-road bridge;

2) Parking the unique trailer on the sidewalk 153 (FIG. 3A) of the bridge;

3) Adjusting independently-adjustable trailer-leveling motorized legs 108 to level the unique trailer;

4) Loading equipment, personnel, and bridge-maintenance goods on anti-slip safety deck 105;

5) Loading equipment, personnel, and bridge-maintenance goods in extendable interchangeable anti-slip-grid catwalk assembly 141;

6) Adjusting telescopic safety-handrail assembly 143 to a desired height for added safety;

7) Inserting telescopic-safety-handrail-assembly adjustable pins 145 though telescopic-safety-handrail-assembly adjustable holes 144;

8) Hooking safety cables to safety-cable-attaching rungs 137;

9) Turning on or off stop-and-go-indicator safety lights 117 for communication between personnel in catwalk assembly 141 and the driver of the unique trailer;

10) Rotating extendable interchangeable quick-release boom assembly 132 by using quick-action-turret assembly 129;

11) Shifting extendable interchangeable anti-slip-grid catwalk assembly 141 through small openings of the bridge (for example, through a less-than-30-inch-wide opening 150 between two cables of a small suspension-cable-type bridge (FIG. 4) or through a less-than-30-inch-wide opening 151 between two posts of a small truss-type bridge (FIG. 5);

12) Extending extendable interchangeable quick-release boom assembly 132;

13) Extending extendable interchangeable quick-release ladder assembly 136;

14) Extending extendable interchangeable anti-slip-grid catwalk assembly 141 (FIGS. 7A and 7B);

15) Shifting extendable interchangeable anti-slip-grid catwalk assembly 141 into nooks and crannies under the bridge (for example, in a less-than-30-inch-wide nook 152 under a bridge (FIGS. 6A and 6B); and 16) Running equipment with convenient-pneumatic-tool compressor 125 built in the unique trailer to maintain and service the bridge.

Reconfiguration of Boom Assembly

1) Releasing quick-release-boom-assembly pins 134 from quick-release-boom-assembly pin holes 133;

2) Replacing extendable interchangeable quick-release boom assembly 132 with another boom assembly;

3) Securing quick-release-boom-assembly pins 134 through quick-release-boom-assembly pin holes 133.

Reconfiguration of Ladder Assembly

1) Releasing quick-release-ladder-assembly pins 139 from quick-release-ladder-assembly pin holes 138;

2) Replacing extendable interchangeable quick-release ladder assembly 136 with another ladder assembly;

3) Securing quick-release-ladder-assembly pins 139 through quick-release-ladder-assembly pin holes 138.

Reconfiguration of Catwalk Assembly

1) Releasing quick-release-catwalk-assembly pins 149 from quick-release-catwalk-assembly pin holes 148;

2) Replacing extendable interchangeable anti-slip-grid catwalk assembly 141 with another catwalk assembly;

3) Securing quick-release-catwalk-assembly pins 149 through quick-release-catwalk-assembly pin holes 148.

Variation

Any of quick-release-boom-assembly pins 134, quick-release-ladder-assembly pins 139, telescopic-safety-hand-rail-assembly adjustable pins 145, quick-release-catwalk-assembly pins 149 can be replaced with a cotter pin, single-ball detent pin, double-ball detent pin, or an equivalent.

Quick-action-turret remote control 130 can be wireless such that quick-action-turret assembly 129 can be operated from a distance, for example, by personnel on extendable interchangeable anti-slip-grid catwalk assembly 141.

Figure 8:
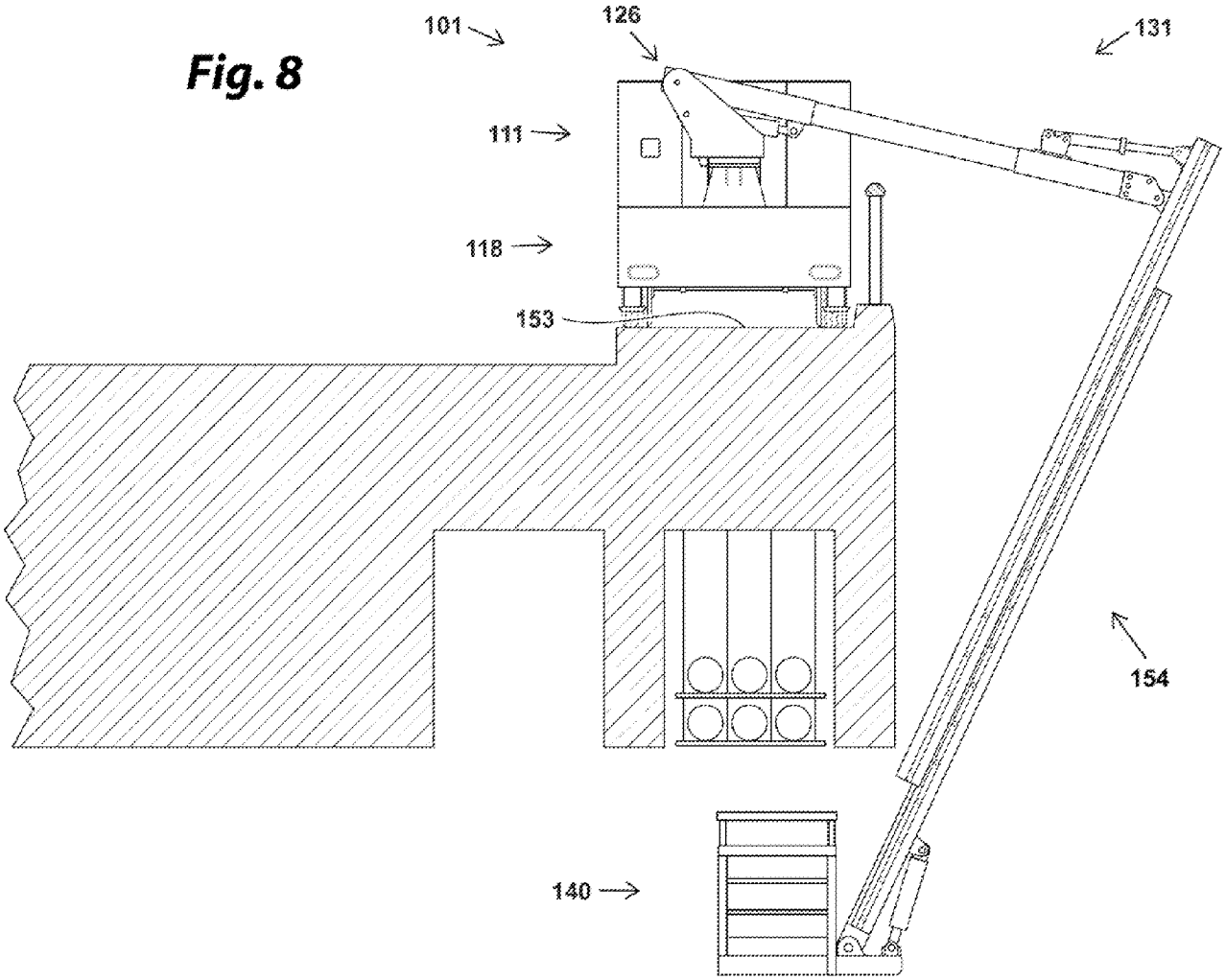
FIG. 8 illustrates an equivalent variation of the extendable interchangeable anti-slip-grid catwalk system.

FIG. 8 illustrates an equivalent variation 154 of extendable interchangeable anti-slip-grid catwalk system 140.

Figure 9:
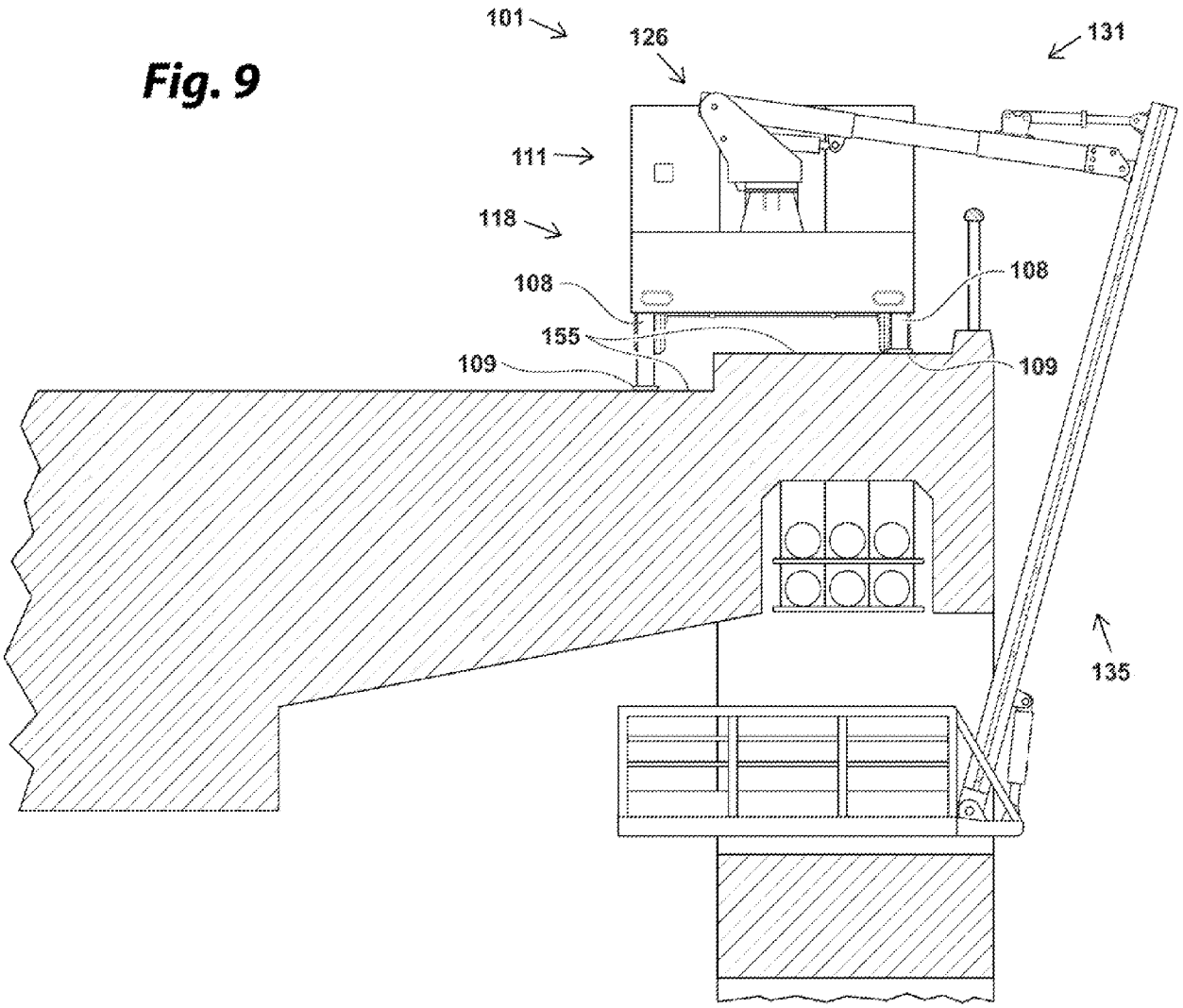
FIG. 9 illustrates how each of the independently-adjustable trailer-leveling motorized legs is independently adjusted to level the unique roadworthy trailer when situated on an uneven surface of a bridge.
Figure 10A:
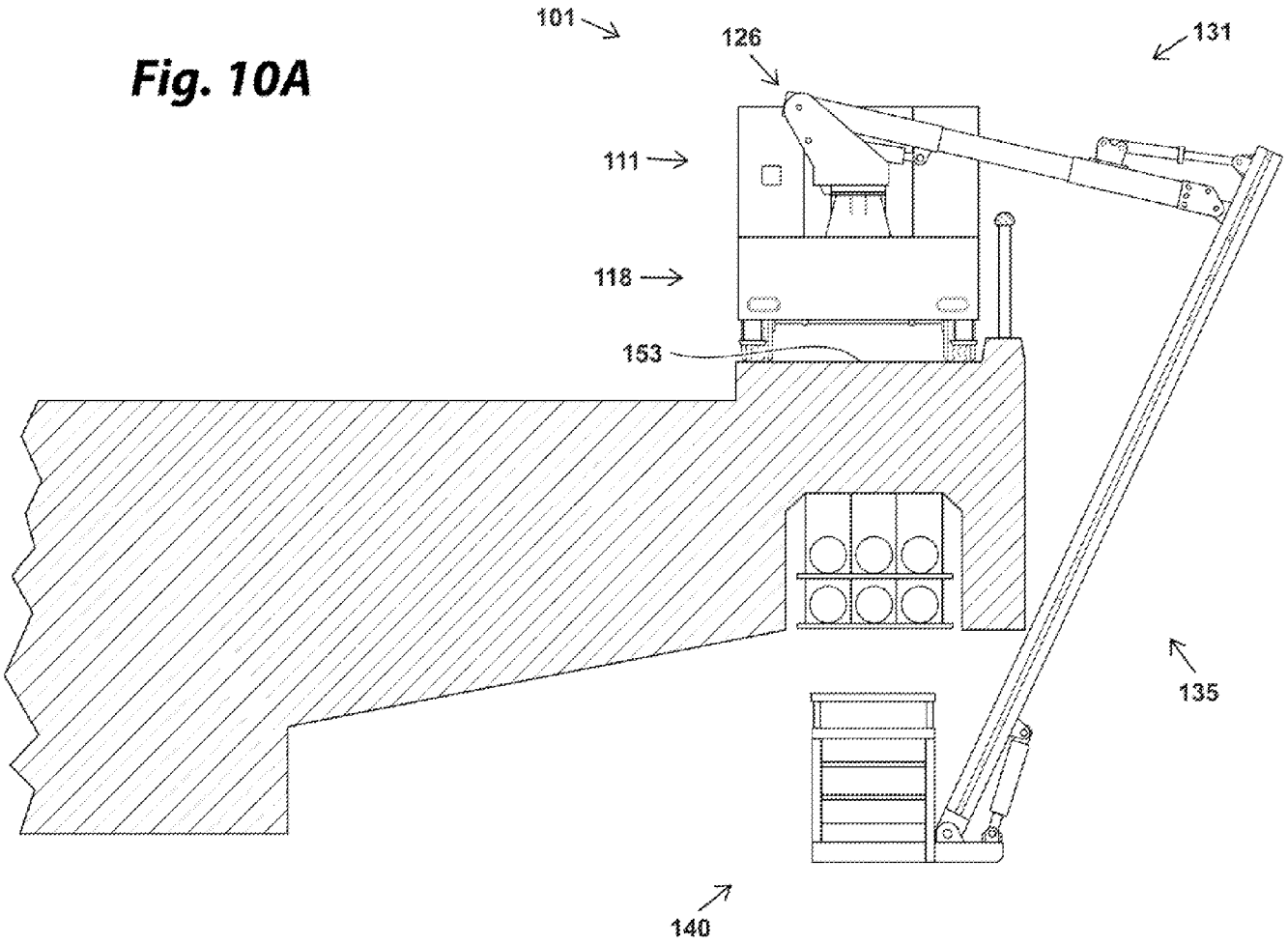
FIGS. 10A, 10B, 10C, and 10D illustrate how to couple three extendable interchangeable anti-slip-grid catwalk systems, working together.
Figure 10B:
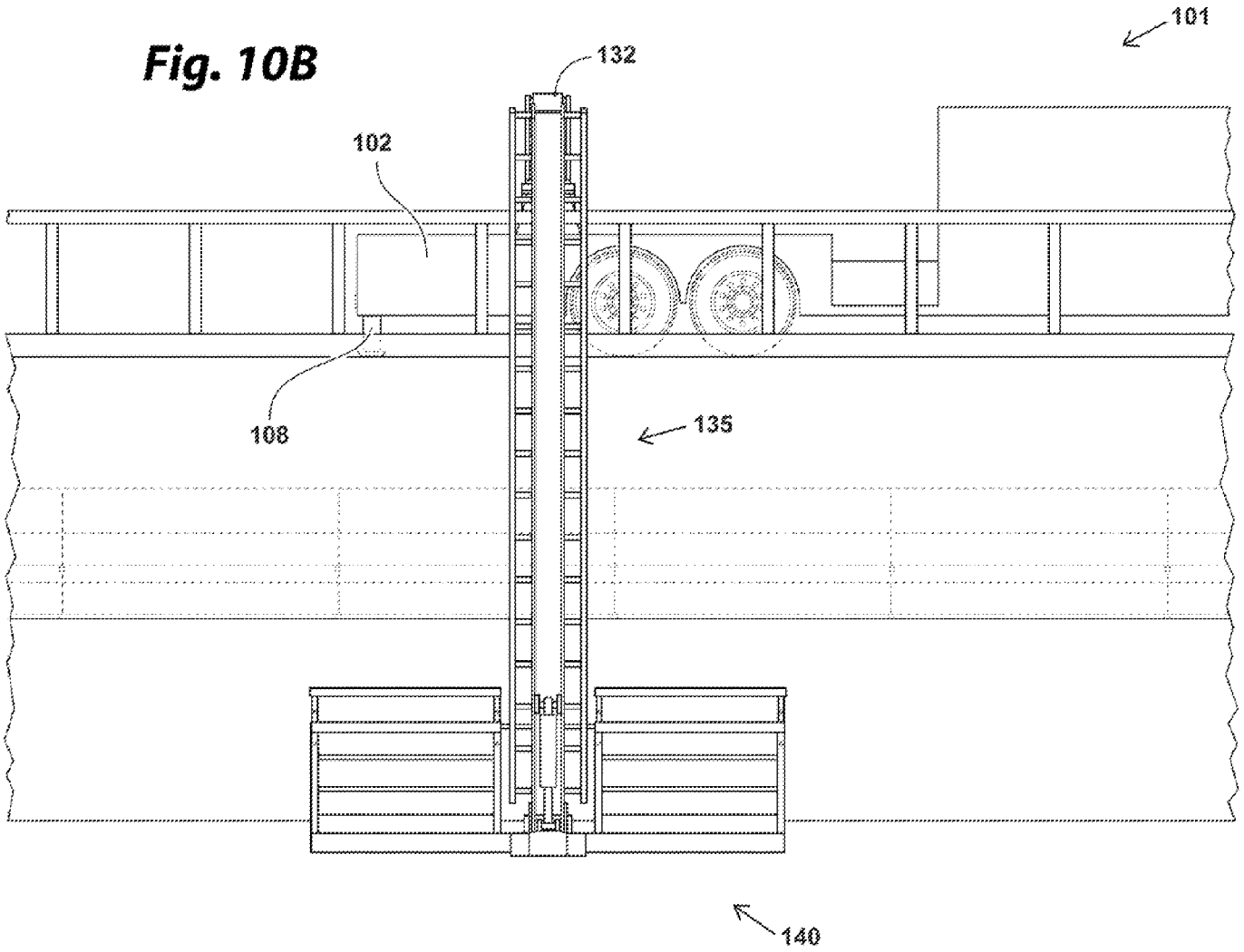
Figure 10C:
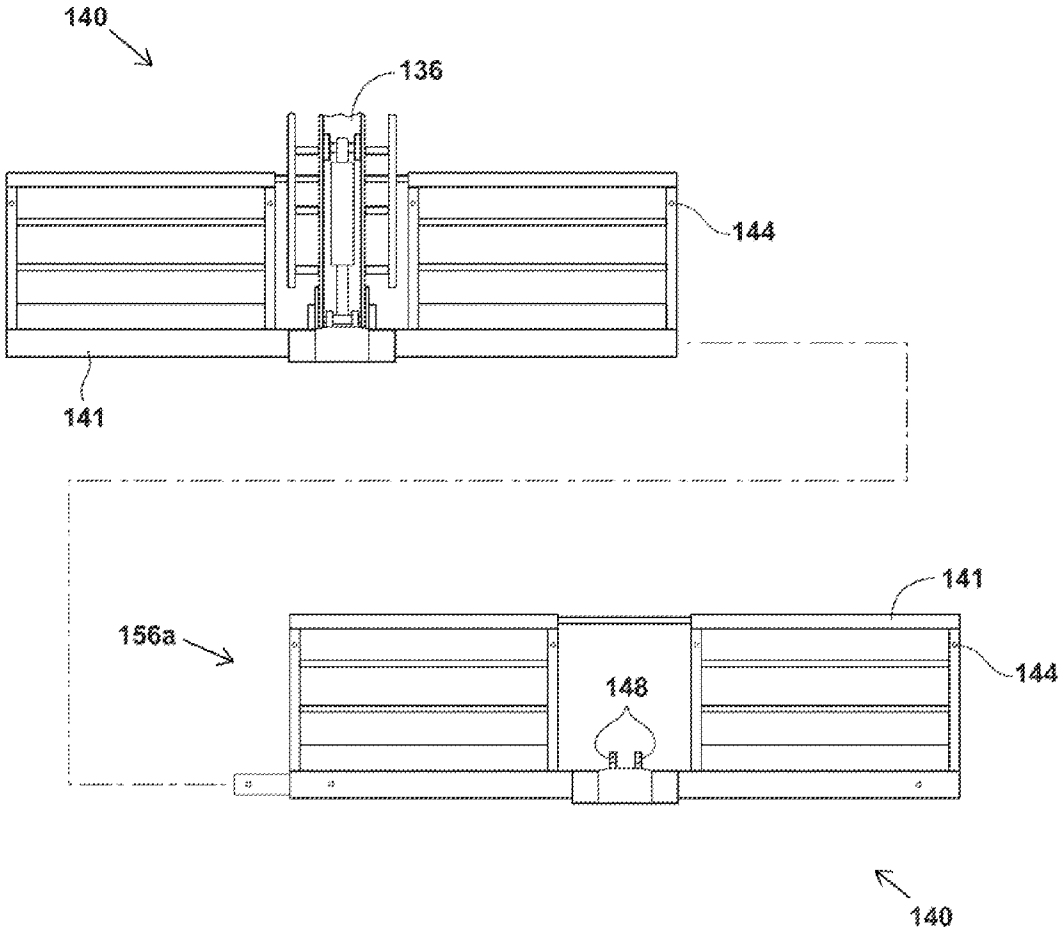
Figure 10D:
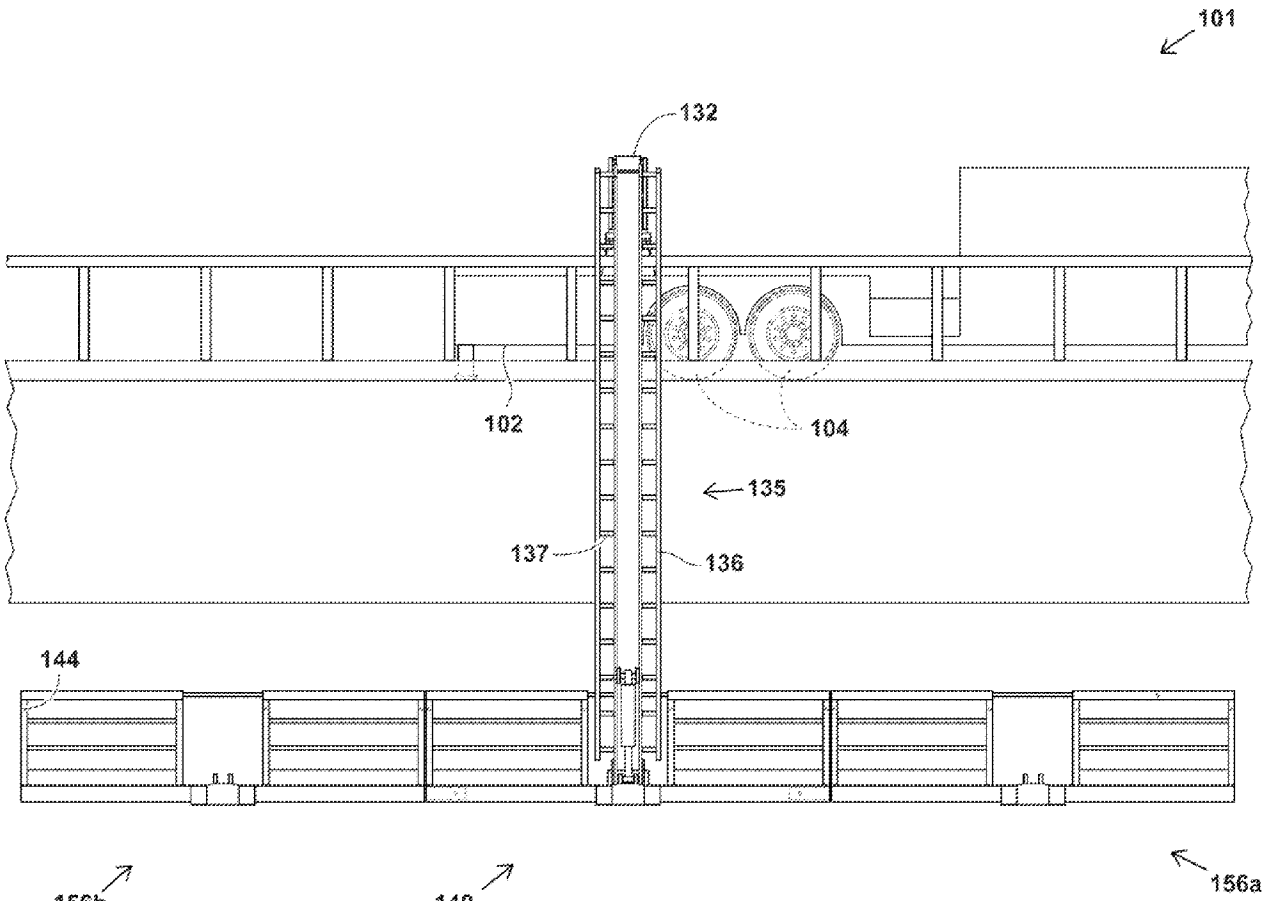

FIG. 9 illustrates how each of independently-adjustable trailer-leveling motorized legs 108 is independently adjusted to level the unique built-in-pneumatic-tool-compressor on-site-extendable-interchangeable-boom on-site-extendable-interchangeable-ladder on-site-extendable-interchangeable-catwalk roadworthy-wheel-and-tire trailer when the unique trailer is parked on an uneven surface 155 on a bridge.

Referring to FIGS. 10A, 10B, 10C, and 10D, further, the unique built-in-pneumatic-tool-compressor on-site-extendable-interchangeable-boom on-site-extendable-interchangeable-ladder on-site-extendable-interchangeable-catwalk roadworthy-wheel-and-tire trailer can be parked on a sidewalk, and can comprise at least one additional extendable interchangeable anti-slip-grid catwalk system (for example, two additional extendable interchangeable anti-slip-grid catwalk systems 156*a* and 156*b*) to extend the width or length of extendable interchangeable anti-slip-grid catwalk system 140.

Figure 11:
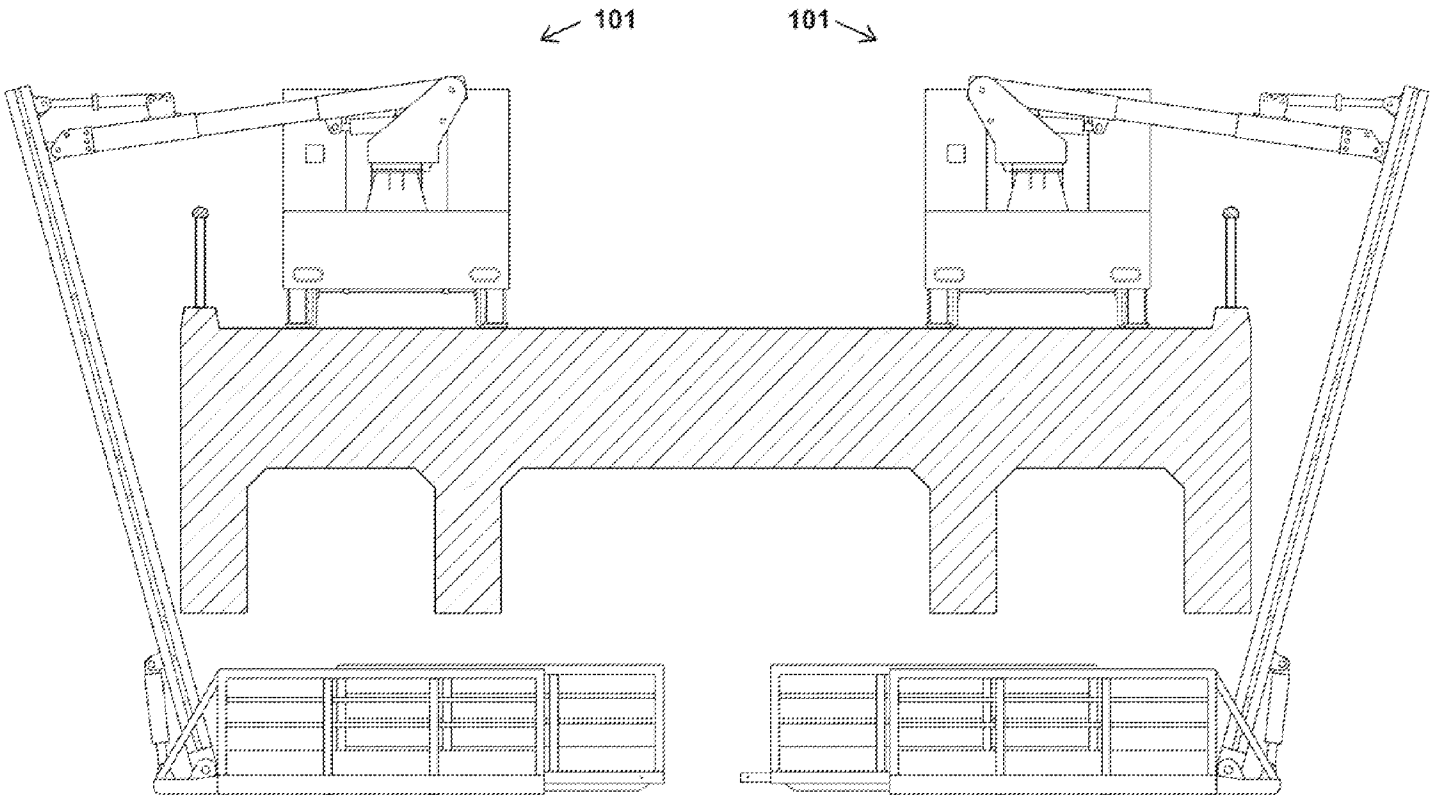
FIGS. 11 and 12 illustrate how two extendable interchangeable anti-slip-grid catwalk systems are coupled together under a bridge to provide a unique extended platform for personnel to maintain and service the entire width of a bridge.
Figure 12:
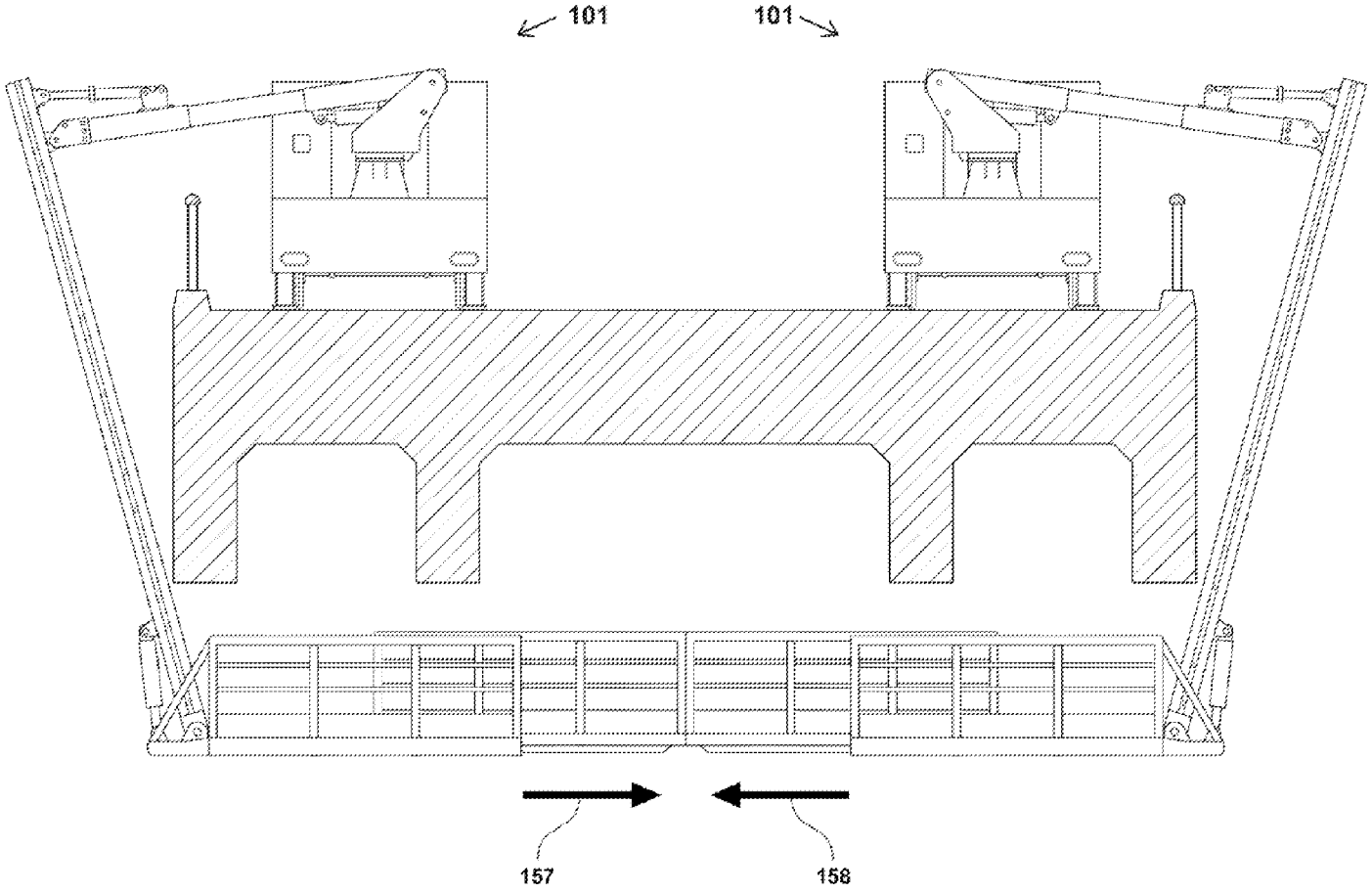

Referring to FIGS. 11 and 12, two extendable interchangeable anti-slip-grid catwalk systems, equivalent to extendable interchangeable anti-slip-grid catwalk system 140 can be coupled together under a bridge, in the opposite directions of arrows 157 and 158, such that their combined length equals the width of the bride to maintain and service the whole width of the bridge.

MAJOR ADVANTAGES OF THE INVENTION

The present invention substantially departs from the conventional concepts and designs of the prior art. In doing so, the present invention provides a unique built-in-pneumatic-tool-compressor on-site-extendable-interchangeable-boom on-site-extendable-interchangeable-ladder on-site-extendable-interchangeable-catwalk roadworthy-wheel-and-tire trailer, having many unique and significant features, functions, and advantages, which overcome all the disadvantages of the prior art, as follows:

1) It is an object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
   a) Can work on:
      small and large suspension-cable-type bridges (suspension bridges),
      small and large truss-type bridges,
      small and large low-power-line bridges,
      small and large high-power-line bridges,
      small and large short-supporting-column bridges,
      small and large tall-supporting-column bridges,
      small and large single-lane bridges,
      small and large multiple-lane bridges,
      small and large regular bridges, and
      small and large rail-road bridges;
   b) Has an extendable interchangeable quick-release boom assembly and an extendable interchangeable anti-slip-grid catwalk assembly, which can maneuver and work in small areas, nooks, and crannies under:
      small and large suspension-cable-type bridges (suspension bridges),
      small and large truss-type bridges,
      small and large low-power-line bridges,
      small and large high-power-line bridges,
      small and large short-supporting-column bridges,
      small and large tall-supporting-column bridges,
      small and large single-lane bridges,
      small and large multiple-lane bridges,
      small and large regular bridges, and
      small and large rail-road bridges;
   c) Has an extendable interchangeable quick-release boom assembly and an extendable interchangeable anti-slip-grid catwalk assembly, which:
      can lift and shift equipment and personnel through narrow openings over and under bridges (for example, through a less-than-30-inch-wide opening between two cables of a small suspension-cable-type bridge or between two posts of a small truss-type bridge),
      can lift and shift bridge-maintenance goods through narrow openings over and under bridges (for example, through a less-than-30-inch-wide opening between two cables of a small suspension-cable-type bridge or between two posts of a small truss-type bridge);
   d) Has four independently-adjustable trailer-leveling motorized legs for adjusting the height at the trailer's four corners, to level the trailer when situated on uneven terrain;
   e) Has roadworthy chassis, wheels, and tires such that the unique trailer can be towed at highway speed; and
   f) Can be sized to operate entirely within the width of a sidewalk.

2) It is another object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
   a) Is able to be towed from one bridge to another, with its boom assembly, ladder assembly, and catwalk assembly pre-installed thereon,
   b) Eliminates the need for an extra roadworthy trailer to carry it from one bridge to another,
   c) Saves materials, production costs, labor, time, and money,
   d) Eliminates the need for loading it on a roadworthy trailer to carry it to a worksite,
   e) Eliminates the need for unloading it from a roadworthy trailer,
   f) Eliminates the need for assembling it,
   g) Eliminates the need for disassembling it, and
   h) Eliminates the need for loading it back on a roadworthy trailer to carry it to another worksite.

3) It is a further object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
   a) Is compact, versatile, pre-installed, and ready for operation, b) Is cheap to operate and maintain,
c) Can be towed by a small, affordable, regular truck, which does not require any special driving license to be operated,
d) Eliminates the need for big, expensive, and specialized truck, and special driving license, and
e) Reduces setup time, and saves time and money.

4) It is an even further object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which, having its turret assembly permanently welded to its deck, and its boom assembly and catwalk assembly pre-installed:
a) Provides stability,
b) Eliminates the need for setting it up, and
c) Saves setup labor and time.

5) It is another object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
a) Has a low compact profile sticking up in the air,
b) Can provide a safe working trailer, in the proximity of low power lines on bridges,
c) Can deploy within a bridge sidewalk, and
d) Can deploy within a bridge sidewalk and/or one traffic lane, with its compact boom and catwalk assembly never encroaching into the second traffic lane.

6) It is yet another object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
a) Has vertically telescopic adjustable safety handrail on its catwalk or basket for workers to lean on and hold on while working, for added safety,
b) Has safety rungs for safety cables, yoyos, fall arrest systems, and/or lanyards to be attached thereto for added safety and maneuverability of workers, and
c) Prevents accidents and personal injuries, and saves time and money.

7) It is still yet another object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
a) Has extendable and interchangeable quick-release boom assembly (with quick-release pins for quick and easy reconfiguration while situated on a bridge) for specific bridge maintenances and services, to provide efficiency, to provide extended horizontal and vertical reaches, to save time, and to save bridge-maintenance-and-service costs,
b) Has extendable and interchangeable quick-release ladder assembly (with quick-release pins for quick and easy reconfiguration while situated on a bridge) for specific bridge maintenances and services, to provide efficiency, to provide extended horizontal and vertical reaches, to save time, and to save bridge-maintenance-and-service costs, and
c) Has extendable and interchangeable anti-slip-grid catwalk or basket assembly (with quick-release pins for quick and easy reconfiguration while situated on a bridge) for specific bridge maintenances and services, to provide efficiency, to provide extended horizontal and vertical reaches, to save time, and to save bridge-maintenance-and-service costs.

8) It is still yet an even further object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
a) Has convenient built-in-pneumatic-tool compressor to run power tools,
b) Has easily and safely accessible, walk-in utility vaults & utility storage, and
c) Has hydraulic motor, pump, and tank located next to the turret assembly to allow for quick activation of the hydraulic system, and save materials, production costs, and money, 9) It is still yet an even further object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
a) Has the turret control located to its catwalk or basket to be operated therefrom to prevent accidents and personal injuries, and to increase efficiency, and
b) Has fuel filler located next to its sidewalk side to be easily accessible, to provide safety, convenience, and efficiency when refilling the unique trailer's fuel tank.

10) It is still yet an even further object of the present invention to provide the unique built-in-pneumatic-tool-compressor on-site-extendable-interchangeable-boom on-site-extendable-interchangeable-ladder on-site-extendable-interchangeable-catwalk roadworthy-wheel-and-tire trailer, which:
a) Has its deck fully coated with anti-slip coating to prevent personal injuries, and
b) Has angled stop-and-go lights relocated to its two front corners to allow both driver and worker see them to better communicate with each other to increase efficiency and to prevent personal injuries.

What is claimed is:

1. A boom trailer, comprising:
a wheeled chassis having an upper side, an underside, and a plurality of corners;
said chassis having a gravitational center, a central axis, and at least one wheel axle,
said central axis of said chassis intersecting said at least one wheel axle;
an undersurface on said underside of the chassis is located lower than said central axis of said chassis;
an anti-slip deck welded to said upper side of said wheeled chassis, said anti-slip deck having a front section and a rear section;
a plurality of independently-adjustable trailer-leveling motorized legs each telescopically attached to said underside of said chassis at a respective one of said corners;
a plurality of leg bases each attached to one of said motorized legs;
a front utility watertight vault system comprising a front utility watertight vault configured for providing safe interior access and locked water-tight storage for tools and equipment;
a lockable top-safety-access watertight door configured for providing a first lockable, water-tight barrier, said top-safety-access watertight door is hingedly connected to said front utility watertight vault;

a lockable interior-safety-access watertight door configured for providing a second lockable, water-tight barrier, said interior-safety-access watertight door is hingedly connected to said front utility watertight vault;

a lockable left-safety-access watertight door configured for providing a third lockable, water-tight barrier, said left-safety-access watertight door is hingedly connected to said front utility watertight vault;

a lockable right-safety-access watertight door configured for providing a fourth lockable, water-tight barrier, said right-safety-access watertight door is hingedly connected to said front utility watertight vault;

a plurality of stop-and-go lights attached to said at least one front utility watertight vault;

a rear utility watertight vault system comprising a rear utility watertight vault attached to said rear section of said anti-slip deck; said rear utility watertight vault providing a second safe interior access and a second locked water-tight storage for tools and equipment;

a lockable rear-safety-access watertight door configured for providing a fifth lockable, water-tight barrier, said rear-safety-access watertight door is hingedly connected to said rear utility watertight vault;

a pneumatic-tool generator assembly attached to said chassis and configured for generating electricity for operating a pneumatic-tool compressor;

a pneumatic-tool compressor assembly attached to said anti-slip deck;

a pneumatic-tool fuel tank;

a turret assembly rotatably attached to said anti-slip deck;

a tank located next to the turret assembly to allow for activation of a hydraulic system, said tank attached to said chassis;

an extendable interchangeable boom assembly extendably and releasably attached to said turret assembly;

a boom-to-turret coupler attached to said extendable interchangeable boom assembly and said turret assembly;

an extendable interchangeable ladder assembly extendably and releasably attached to said extendable interchangeable boom assembly;

a ladder-to-boom coupler attached to said extendable interchangeable ladder assembly and said extendable interchangeable boom assembly;

a plurality of safety-cable-attaching rungs welded to said extendable interchangeable ladder assembly;

an extendable interchangeable catwalk assembly extendably and releasably attached to said extendable interchangeable ladder assembly;

a catwalk-to-ladder coupler attached to said extendable interchangeable catwalk assembly and said extendable interchangeable ladder assembly;

a telescopic adjustable safety-handrail assembly telescopically and adjustably connected to and extending from said extendable interchangeable catwalk assembly; and a turret remote control; attached to said turret assembly or said trailer chassis, said turret remote control configured for controlling the rotation of said extendable interchangeable boom system, a motorized-leg remote control, attached to said chassis and configured for adjusting a height of said independently- adjustable trailer-leveling motorized legs;

wherein said wheeled chassis is and configured for providing a mobile platform;

said independently-adjustable trailer-leveling motorized legs each are configured for providing independent and motorized adjustments to level said trailer;

said leg bases each are configured for stabilizing a respective one of said independently-adjustable trailer-leveling motorized legs;

said stop-and-go lights each are configured for facilitating communications;

said turret assembly is configured for radially rotating said extendable interchangeable boom assembly, said extendable interchangeable ladder assembly, and said extendable interchangeable catwalk assembly;

said extendable interchangeable boom assembly and said extendable interchangeable ladder assembly are configured for lifting and shifting said extendable interchangeable catwalk assembly;

said boom-to-turret coupler is configured for coupling and uncoupling said extendable interchangeable boom assembly to and from said turret assembly, respectively;

said ladder-to-boom coupler is configured for coupling and uncoupling said extendable interchangeable ladder assembly to and from said extendable interchangeable boom assembly, respectively;

said catwalk-to-ladder coupler is configured for coupling and uncoupling said extendable interchangeable catwalk assembly to and from said extendable interchangeable ladder assembly, respectively;

said telescopic adjustable safety-handrail assembly is configured for holding on by a user.

2. The boom trailer of claim 1, wherein, said extendable interchangeable catwalk assembly is configured for lifting and shifting personnel and equipment behind a bridge column.

3. The boom trailer of claim 1, wherein, said boom trailer is configured to operate with a sidewalk.

4. The boom trailer of claim 1, further, comprising at least one catwalk-to-catwalk coupler and at least one additional extendable interchangeable catwalk assembly, said at least one catwalk-to-catwalk coupler configured for coupling and uncoupling said extendable interchangeable catwalk assembly to and from said at least one additional extendable interchangeable catwalk assembly respectively.

5. The boom trailer of claim 4, wherein, said extendable interchangeable catwalk assembly has two opposite sides, said at least one additional extendable interchangeable catwalk assembly comprises two additional extendable interchangeable catwalks, said extendable interchangeable catwalk assembly is coupled to said two additional extendable interchangeable catwalks on said two opposite sides, respectively.

6. The boom trailer of claim 4, wherein, said extendable interchangeable catwalk assembly and said at least one additional extendable interchangeable catwalk assembly together to form a letter-T-shape or a letter I-shape.

7. The boom trailer of claim 1, further, comprising an anti-slip coating attached to said anti-slip deck and configured for preventing slippage.

8. The boom trailer of claim 1, wherein, said quick-release boom-to-turret coupler has at least one hole, at least one nut, and at least one screw, said at least one screw is configured for insertion through said at least one hole, said at least one nut is configured for being threaded on said at least one screw to secure said at least one screw.

9. The boom trailer of claim 1, wherein, said quick-release catwalk-to-ladder coupler has at least one hole, at least one nut, and at least one screw; said at least one screw is configured for insertion through said at least one hole; said at least one nut is configured for being threaded on said at least one screw to secure said at least one screw.

10. The boom trailer of claim 1, wherein, said quick-release catwalk-to-ladder coupler has at least one hole, at least one nut, and at least one screw; said at least one screw is configured for insertion through said at least one hole; said at least one nut is configured for being threaded on said at least one screw to secure said at least one screw.

11. The boom trailer of claim 1, further, comprising a plurality of safety footwalls, wherein said extendable interchangeable catwalk assembly has a floor and a perimeter, said safety footwalls welded to and along said perimeter of said floor.

12. The boom trailer of claim 1, said telescopic adjustable safety-handrail assembly has at least one hole and at least one pin; said at least one pin is configured for insertion through a respective said at least one hole to adjustably secure said telescopic adjustable safety-handrail assembly.

13. The boom trailer of claim 1, further, comprising a safety chain releasably attached to said extendable interchangeable catwalk assembly, wherein said extendable interchangeable catwalk assembly has an entry-exit opening, said safety chain configured for releasably closing said entry-exit opening.

14. A boom trailer, comprising:

a wheeled chassis having an upper side, an underside, and a plurality of corners;

said chassis having a gravitational center, a central axis, and at least one wheel axle, said central axis of said chassis intersecting said at least one wheel axle;

an undersurface on said underside of the chassis is located lower than said central axis of said chassis;

an anti-slip deck welded to said upper side of said wheeled chassis;

a plurality of independently-adjustable trailer-leveling motorized legs each attached to said underside of said chassis at a respective one of said corners;

at least one water-tight vault attached to said anti-slip deck;

at least one lockable safety-access watertight door configured for providing a lockable, water-tight barrier, said safety-access watertight door is hingedly connected to said watertight vault;

a plurality of stop-and-go lights attached to said at least one vault;

a pneumatic-tool generator assembly attached to said chassis configured for generating electricity for operating a pneumatic-tool compressor;

a pneumatic-tool compressor assembly attached to said anti-slip deck;

a pneumatic-tool fuel tank;

a turret assembly rotatably attached to said anti-slip deck;

a tank located next to the turret assembly to allow for activation of a hydraulic system, said tank assembly attached to said chassis;an extendable boom assembly releasably attached to said turret assembly;

a boom-to-turret coupler attached to said extendable boom assembly and said turret assembly;

an extendable ladder assembly releasably attached to said extendable boom assembly;

a ladder-to-boom coupler attached to said extendable ladder assembly and said extendable boom assembly;

a plurality of safety-cable-attaching rungs welded to said extendable ladder assembly;

an extendable catwalk assembly releasably attached to said extendable ladder assembly;

a catwalk-to-ladder coupler attached to said extendable catwalk assembly and said extendable ladder assembly;

an adjustable safety-handrail assembly adjustably connected to and extending from said extendable catwalk assembly; and a turret remote control; attached to said turret assembly or said trailer chassis, said turret remote control configured for controlling the rotation of said extendable interchangeable boom system, a motorized-leg remote control, attached to said chassis and configured for adjusting a height of said independently-adjustable trailer-leveling motorized legs;

wherein, said wheeled chassis is configured for providing a mobile platform;

said independently-adjustable trailer-leveling motorized legs each are configured for being independently and motorizedly adjustable to level said trailer;

said at least one vault is configured for storage;

said stop-and-go lights each are configured for facilitating communications;

said turret assembly is configured for radially rotating said extendable boom assembly, said extendable ladder assembly, and said extendable catwalk assembly;

said extendable boom assembly and said extendable ladder assembly are configured for lifting and shifting said extendable catwalk assembly;

said boom-to-turret coupler is configured for coupling and uncoupling said extendable boom assembly to and from said turret assembly, respectively;

said ladder-to-boom coupler is configured for coupling and uncoupling said extendable ladder assembly to and from said extendable boom assembly, respectively;

said catwalk-to-ladder coupler is configured for coupling and uncoupling said extendable catwalk assembly to and from said extendable ladder assembly, respectively; said adjustable safety-handrail assembly is configured for holding on by a user.

15. The boom trailer of claim 14, wherein, said extendable interchangeable catwalk assembly is configured for lifting and shifting personnel and equipment behind a bridge column.

16. The boom trailer of claim 14, wherein, said boom trailer is configured to operate with a sidewalk.

17. The boom trailer of claim 14, further, comprising at least one catwalk-to-catwalk coupler and at least one additional extendable interchangeable catwalk assembly, said at least one catwalk-to-catwalk coupler configured for coupling and uncoupling said extendable interchangeable catwalk assembly to and from said at least one additional extendable interchangeable catwalk assembly respectively.

18. The boom trailer of claim 17, wherein, said extendable interchangeable catwalk assembly has two opposite sides, said at least one additional extendable interchangeable catwalk assembly comprises two additional extendable interchangeable catwalks, said extendable interchangeable catwalk assembly is coupled to said two additional extendable interchangeable catwalks on said two opposite sides, respectively.

19. The boom trailer of claim 17, wherein, said extendable interchangeable catwalk assembly and said at least one additional extendable interchangeable catwalk assembly together to form a letter-T-shape or a letter I-shape.

* * * * *